US009000997B2

(12) United States Patent
Ando

(10) Patent No.: US 9,000,997 B2
(45) Date of Patent: Apr. 7, 2015

(54) STRUCTURE AND ANTENNA

(75) Inventor: Noriaki Ando, Tokyo (JP)

(73) Assignee: NEC Corporation, Tokyo (JP)

( * ) Notice: Subject to any disclaimer, the term of this patent is extended or adjusted under 35 U.S.C. 154(b) by 301 days.

(21) Appl. No.: 13/514,172

(22) PCT Filed: Dec. 6, 2010

(86) PCT No.: PCT/JP2010/007094
§ 371 (c)(1),
(2), (4) Date: Jun. 6, 2012

(87) PCT Pub. No.: WO2011/070763
PCT Pub. Date: Jun. 16, 2011

(65) Prior Publication Data

US 2012/0242556 A1 Sep. 27, 2012

(30) Foreign Application Priority Data

Dec. 7, 2009 (JP) ..... 2009-277551

(51) Int. Cl.
*H01Q 15/02* (2006.01)
*H01Q 9/04* (2006.01)
(Continued)

(52) U.S. Cl.
CPC ..... *H01Q 9/0407* (2013.01); *H01Q 9/42* (2013.01); *H01Q 21/065* (2013.01); *H01Q 15/008* (2013.01); *H01Q 15/0086* (2013.01); *H01Q 15/006* (2013.01)

(58) Field of Classification Search
CPC ..... H01Q 15/006; H01Q 15/0066; H01Q 15/008; H01Q 15/0086; H01Q 15/12
USPC ..... 343/700 MS, 834, 909
See application file for complete search history.

(56) References Cited

U.S. PATENT DOCUMENTS 6,262,495 B1 7/2001 Yablonovitch et al.
6,768,476 B2 * 7/2004 Lilly et al. ..... 343/909
(Continued)

FOREIGN PATENT DOCUMENTS

JP 2007-522735 A 8/2007
JP 2008-507733 A 3/2008
(Continued)

OTHER PUBLICATIONS

Chinese Office Action dated Jan. 2, 2014 with an English translation.
(Continued)

*Primary Examiner* — Tan Ho
(74) *Attorney, Agent, or Firm* — McGinn IP Law Group, PLLC.

(57) ABSTRACT

A plurality of first conductor patterns (200) are insular electrode patterns located at a first layer. The first conductor patterns (200) are arranged in a repetitive pattern and are separated from each other. A second conductor pattern (100) is located at a second layer parallel to the first layer, and extends in a sheet shape in a region opposite the plurality of first conductor patterns (200). An opening (300) is provided in each of the plurality of first conductor patterns (200). Third conductor patterns (400) are located at the first layer and disposed in each of a plurality of openings (300). The third conductor patterns (400) are separated from the first conductor patterns (200). Connection conductors (500) connect the third conductor patterns (400) to the first conductor patterns (200).

28 Claims, 54 Drawing Sheets

(51) Int. Cl.

| | |
|---|---|
| ***H01Q 9/42*** | (2006.01) |
| ***H01Q 21/06*** | (2006.01) |
| ***H01Q 15/00*** | (2006.01) |

(56) References Cited

U.S. PATENT DOCUMENTS

| | | | | |
|---|---|---|---|---|
| 7,429,961 | B2 * | 9/2008 | Sievenpiper et al. | 343/909 |
| 7,446,712 | B2 | 11/2008 | Itoh et al. | |
| 7,538,946 | B2 | 5/2009 | Smith et al. | |
| 7,719,463 | B2 | 5/2010 | Migliaccio et al. | |
| 7,859,482 | B1 * | 12/2010 | Herting | 343/909 |
| 8,354,975 | B2 * | 1/2013 | Ando et al. | 343/913 |
| 2007/0176827 | A1 | 8/2007 | Itoh et al. | |
| 2007/0257853 | A1 | 11/2007 | Gevorgian et al. | |
| 2008/0165079 | A1 | 7/2008 | Smith et al. | |
| 2009/0153391 | A1 | 6/2009 | Migliaccio et al. | |
| 2010/0067091 | A1 | 3/2010 | Smith et al. | |
| 2011/0170267 | A1 * | 7/2011 | Ando | 361/748 |

FOREIGN PATENT DOCUMENTS

| | | | |
|---|---|---|---|
| JP | 2008-147763 | A | 6/2008 |
| JP | 2009-515397 | A | 4/2009 |
| WO | WO 99/50929 | A1 | 10/1999 |
| WO | WO 2010 029770 | A1 | 3/2010 |

OTHER PUBLICATIONS

International Search Report in PCT/JP2010/007094 dated Mar. 8, 2011(English Translation.

L. Moustafa, et al., Design Method of EBG Material with wide defect band, 2009 3rd European Conference on Antennas and Propagations, EuCAP 2009 Proceedings, VDE Verlag GmbH, Mar. 2009, pp. 3235-3239.

Chinese Office action dated Jul. 10, 2014 with an English translation thereof.

* cited by examiner (a)

(b)

(a)

(b)

(a)

(b)

A—A´

(a)

(b)

(a)

(b)

(a)

(b)

(a)

(b)

(a)

(b)

(a)

(b)

STRUCTURE AND ANTENNA

TECHNICAL FIELD

The present invention relates to a structure and an antenna representing meta-material characteristics.

BACKGROUND ART

In recent years, it has been revealed that the propagation characteristics of electromagnetic waves is controlled by periodic arrangement of conductor patterns having a specific structure (hereinafter, called a meta-material). For example, the use of a meta-material enables a reduction in size and thickness of an antenna.

Examples of related art relevant to a meta-material include techniques disclosed in Patent Documents 1 and 2. A technique disclosed in Patent Document 1 relates to a structure, or a so-called mushroom-type meta-material in which a plurality of insular conductor patterns are disposed above sheet-like conductor patterns, and each of the insular conductor patterns is connected to a sheet-like conductor pattern through a via.

A technique disclosed in Patent Document 2 provides a layer including a second auxiliary conductor pattern between a layer in which insular conductor patterns are formed and a layer in which sheet-like conductor patterns are formed, in a mushroom-type meta-material. The second auxiliary conductor pattern is formed so as to fill the gaps between the insular conductor patterns in a plan view, and is not connected to any of the insular conductor pattern and the sheet-like conductor patterns.

RELATED DOCUMENTS

Patent Documents

[Patent Document 1] Specification of U.S. Pat. No. 6,262,495

[Patent Document 2] Specification of U.S. Patent Application Publication No. 2007/0176827

DISCLOSURE OF THE INVENTION

However, the techniques disclosed in Patent Documents 1 and 2 require to form one or more vias with respect to one insular conductor pattern. For this reason, manufacturing costs increase.

An object of the invention is to provide a structure representing meta-material characteristics and an antenna making use of the structure, with no need to use a via.

According to the invention, there is provided a structure including:

- a plurality of first insular conductors located at a first layer and arranged in a repetitive pattern;
- a second conductor located at a second layer different from the first layer, at least a portion of the second conductor being provided in a region opposite the plurality of first conductors;
- an opening provided in the plurality of first conductors;
- a third conductor located at the first layer and arranged in the opening, the third conductor being separated from the first conductors; and
- a connection conductor connecting the third conductor to the first conductors.

According to the invention, there is provided a structure including:

- a plurality of first conductors located at a first layer and arranged in a repetitive pattern;
- a second conductor located at a second layer different from the first layer, at least a portion of the second conductor being provided in a region opposite the plurality of first conductors;
- a plurality of openings provided in the second conductor, the openings being opposite the plurality of first conductors;
- a third conductor located at the second layer and arranged in the plurality of openings; and
- a connection conductor connecting the third conductor to the first conductors.

According to the invention, there is provided an antenna having the above-mentioned structure.

According to the invention, it is possible to provide a structure representing meta-material characteristics and an antenna making use of the structure, with no need to use a via. In addition, it is possible to achieve a reduction in size and thickness of the antenna.

BRIEF DESCRIPTION OF THE DRAWINGS

The above-mentioned objects, other objects, features and advantages will be made clearer from the preferred embodiments described below, and the following accompanying drawings.

DESCRIPTION OF EMBODIMENTS

Figure 1:
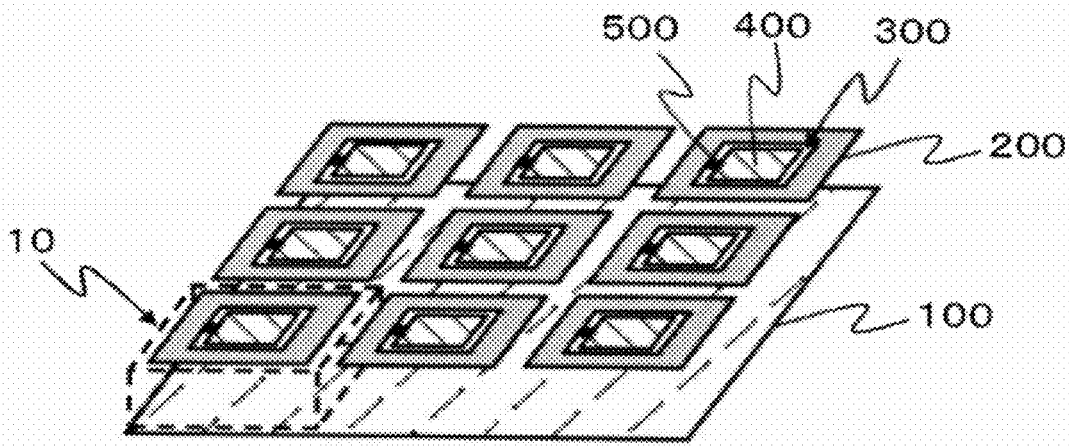
FIG. 1 is a perspective view illustrating a configuration of a structure according to a first embodiment.

Hereinafter, the embodiments of the invention will be described with reference to the accompanying drawings. In all the drawings, like elements are referenced by like reference numerals and signs and descriptions thereof will not be repeated.

Figure 2:
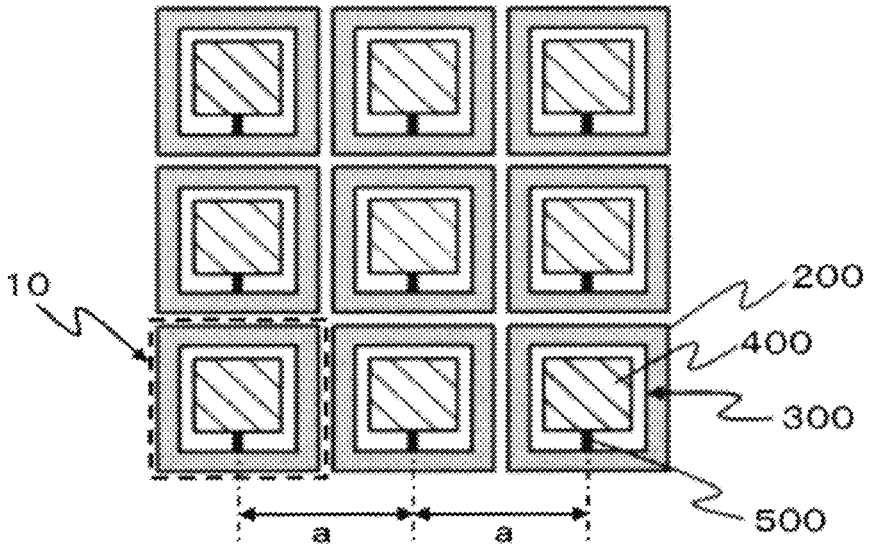
FIG. 2(*a*) is a plan view illustrating a first layer of the structure shown in FIG. 1, and FIG. 2(*b*) is a plan view illustrating a second layer of the structure shown in FIG. 1.
Figure 2:
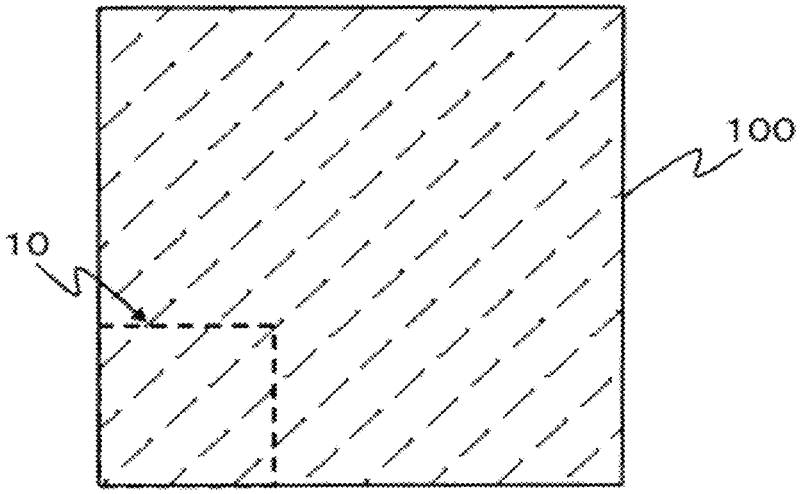

FIG. 1 is a perspective view illustrating a configuration of a structure according to a first embodiment. FIG. 2 (*a*) is a plan view illustrating a first layer of the structure shown in FIG. 1, and FIG. 2 (*b*) is a plan view illustrating a second layer of the structure shown in FIG. 1.

This structure includes a plurality of first conductor patterns 200 for a first conductor, a second conductor pattern 100 for a second conductor, openings 300, third conductor patterns 400 for a third conductor, and connection conductors 500. A plurality of first conductor patterns 200 are insular electrode patterns, are located at a first layer. The first conductor patterns 200 are arranged in a repetitive pattern, for example, in a periodic pattern and are separated from each other. The second conductor pattern 100 is located at a second layer parallel to the first layer. At least a portion of the second conductor pattern 100 is provided in a region opposite a plurality of first conductor patterns 200. In the example shown in the drawing, the second conductor pattern 100 extends in a sheet shape in the region opposite a plurality of first conductor patterns 200. The opening 300 is provided in each of a plurality of first conductor patterns 200. The third conductor patterns 400 are located at the first layer and are disposed in each of a plurality of openings 300. The third conductor patterns 400 are separated from the first conductor patterns 200. The connection conductors 500 connect the third conductor patterns 400 to the first conductor patterns 200.

In the embodiment, the first layer and the second layer are provided in a position facing each other through, for example, a dielectric layer. The third conductor patterns 400 and the connection conductors 500 are provided in the first layer.

In the embodiment, a unit cell 10 of the structure is constituted by a rectangular space including the first conductor pattern 200, the opening 300, the third conductor pattern 400, the connection conductor 500, and the region in the second conductor pattern 100 opposite these elements. Periodic arrangement of the unit cell 10 enables this structure to function as a meta-material, for example, an electromagnetic band gap (EBG). In the examples shown in FIGS. 1 and 2, the unit cells 10 have a two-dimensional array in a plan view. More specifically, the unit cell 10 is disposed in each lattice point of a square lattice of which the lattice constant is a. For this reason, the center-to-center distances of a plurality of first conductor patterns 200 are the same as each other.

A plurality of unit cells 10 have the same structure, and are disposed in the same direction. In the embodiment, the first conductor pattern 200, the opening 300, and the third conductor pattern 400 are square, and each of them is so disposed that their centers overlap each other. The connection conductor 500 has an interconnect shape, and connects the center of a first side of the third conductor pattern 400 to the center of a second side corresponding to a side opposite the first side of the third conductor pattern 400 in the opening 300.

Next, an example of a method of manufacturing the structure will be described. First, a conductive film is formed on both sides of a sheet-like dielectric layer. A mask pattern is formed on one conductive film, and the conductive film is etched using this mask pattern for a mask. Thus, a plurality of first conductor patterns 200, the openings 300, the third conductor patterns 400, and the connection conductors 500 are formed. The other conductive film can be used as the second conductor pattern 100 as it is.

Figure 3:
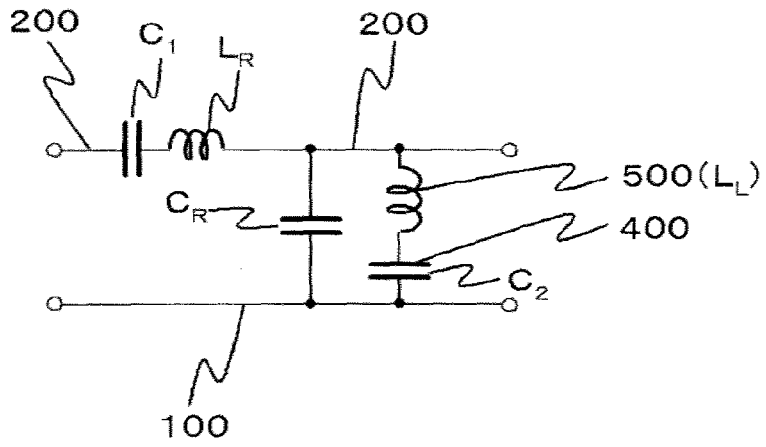
FIG. 3(*a*) is an equivalent circuit diagram illustrating a unit cell shown in FIG. 1 and FIG. 2, and FIG. 3(*b*) is a dispersion curve illustrating the structure shown in FIGS. 1 and 2.
Figure 3:
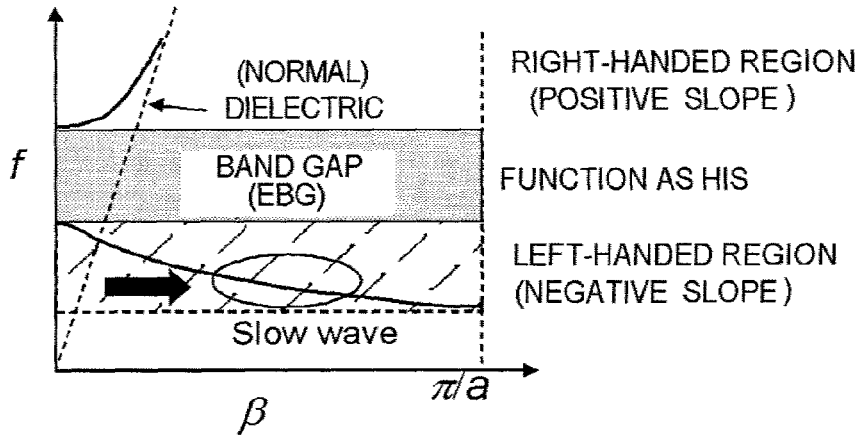

FIG. 3(*a*) is an equivalent circuit diagram illustrating the unit cell 10 shown in FIGS. 1 and 2. First, a parasitic capacitance $C_R$ is formed between the first conductor pattern 200 and the second conductor pattern 100. A first capacitance $C_1$ is formed by the first conductor patterns 200 adjacent to each other, and a second capacitance $C_2$ is formed between the third conductor pattern 400 and the second conductor pattern 100. Each of the first conductor patterns 200 has a parasitic inductance $L_R$. The connection conductor 500 provides an inductance $L_L$ to an interconnect connecting the first conductor pattern 200 to the third conductor pattern 400.

The equivalent circuit of the unit cell 10 shown in the drawing is the same as an equivalent circuit of a mushroom structure except that the second capacitance $C_2$ exists. The meta-material shown in FIG. 1 represents the frequency characteristics similar to the mushroom structure in a band having a series resonance frequency or higher based on the inductance $L_L$ and the second capacitor $C_2$. The parasitic capacitance $C_R$ can be controlled by the area of the first conductor pattern 200, and the relative permittivity and the thickness of the dielectric layer located between the first layer and the second layer. The first capacitance $C_1$ can be controlled by the gap between the first conductor patterns 200 and the length of one side of the first conductor patterns 200. The second capacitance $C_2$ can be controlled by the area of the third conductor pattern 400, and the relative permittivity and the thickness of the dielectric layer located between the first layer and the second layer. The inductance $L_L$ can be controlled by the length and the diameter of the connection conductor 500. For this reason, when the structure shown in FIG. 1 is used as an EBG, the frequency band functioning as an EBG can be controlled by controlling the above values.

FIG. 3(*b*) is a dispersion curve illustrating the structure shown in FIGS. 1 and 2. As shown in the dispersion curve, when the frequency is low, the structure functions as a so-called left-handed-system meta-material. As the frequency becomes lower, the wavelength becomes shorter. Within a certain range having a higher frequency, electromagnetic waves are not propagated but reflected, and thus the frequency functions as an EBG. The frequency higher than the frequency functioning as an EBG allows a structure to function as a right-handed-system medium similarly to a normal dielectric.

At stated above, according to the first embodiment, a structure functioning as a meta-material can be formed by the first layer and the second layer. For this reason, the structure is formed without using a via, and thus manufacturing costs of the structure can be reduced.

Figure 4:
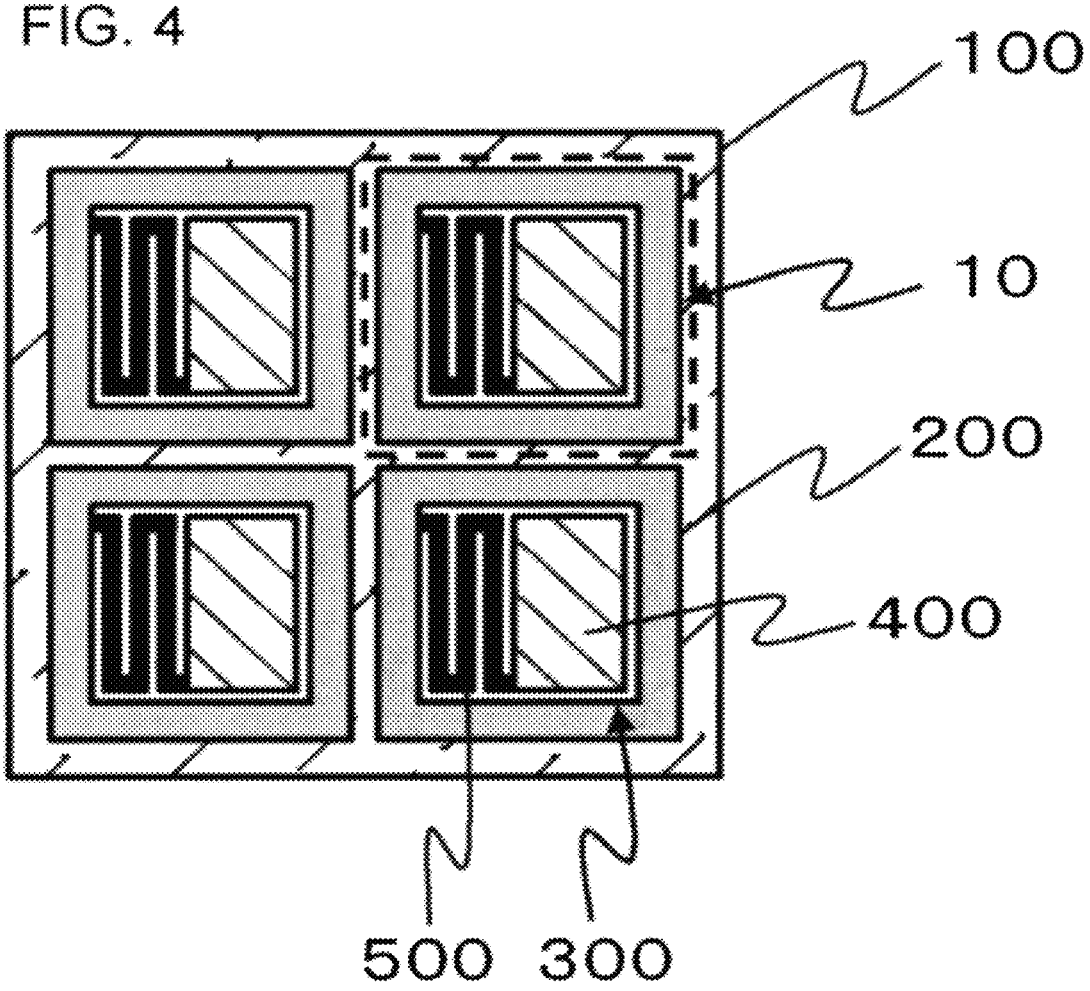
FIG. 4 is a top view illustrating a configuration of a structure according to a second embodiment.

FIG. 4 is a top view illustrating a configuration of a structure according to a second embodiment. This structure has the same configuration as that of the structure according to the first embodiment, except that the connection conductor 500 extends in a meandering shape in the space in the opening 300 in which the third conductor pattern 400 is not provided.

Specifically, the opening 300 is square, but the third conductor pattern 400 is rectangular. The center of the opening 300 and the center of the third conductor pattern 400 do not overlap each other. For this reason, in the embodiment, as compared to the first embodiment, a lot of spaces in which the third conductor pattern 400 is not provided are present in the inside of the opening 300. The connection conductor 500 has an interconnect shape, and extends through the above-mentioned space in a meandering shape, that is, in a zigzag manner. Meanwhile, the shapes and the directions of the connection conductors 500 are the same as each other in all the unit cells 10.

In the embodiment, the same effect as that of the first embodiment can also be obtained. In addition, since the connection conductor 500 can be lengthened, it is possible to increase $L_L$ in FIG. 3. In large $L_L$, it is possible to shift the band gap frequency of the structure used for an EBG, toward the low-frequency side.

Figure 5:
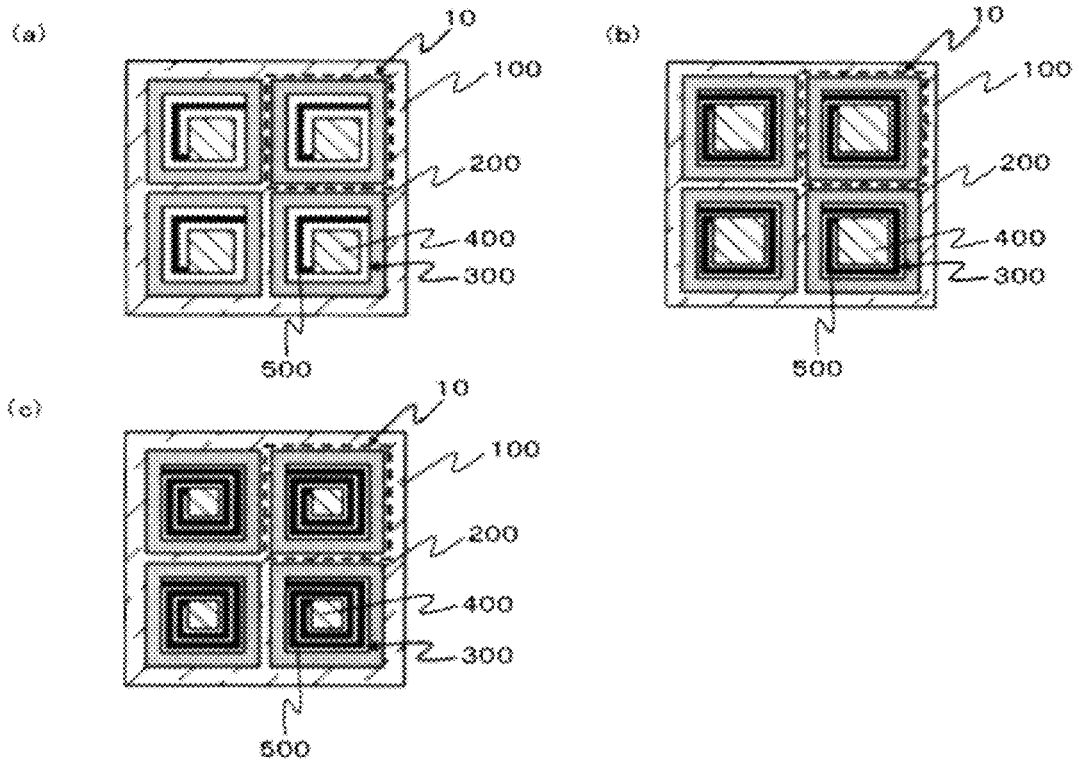
FIG. 5 is a top view illustrating a configuration of a structure according to a third embodiment.

Each drawing of FIG. 5 is a top view illustrating a configuration of a structure according to a third embodiment. This structure has the same configuration as that of the structure according to the first embodiment, except that the connection conductor 500 extends so as to surround the third conductor pattern 400 within the opening 300.

For example, in the example shown in FIG. 5(*a*), the connection conductor 500 extends along two sides constituting one corner in the third conductor pattern 400. In this case, the center of the third conductor pattern 400 and the center of the opening 300 do not overlap each other. In the example shown in FIG. 5(*b*), the connection conductor 500 forms only one circuit to surround the third conductor pattern 400. In the example shown in FIG. 5(*c*), the connection conductor 500 surrounds the third conductor pattern 400 multiple times. Meanwhile, in the examples shown in FIGS. 5(*b*) and 5(*c*), the center of the third conductor pattern 400 and the center of the opening 300 overlap each other.

In the embodiment, the same effect as that of the first embodiment can also be obtained. In addition, since the connection conductor 500 can be lengthened, it is possible to increase $L_L$ in FIG. 3.

Figure 6:
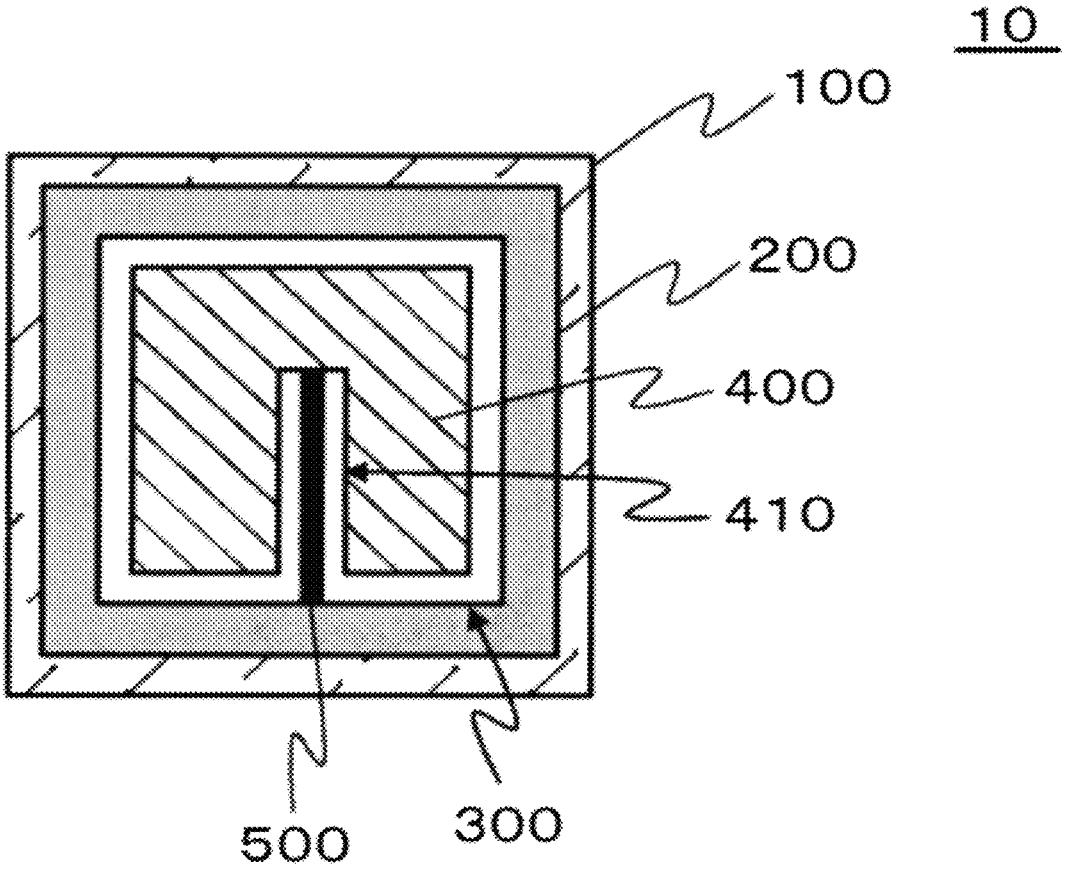
FIG. 6 is a top view illustrating a configuration of a structure according to a fourth embodiment.

FIG. 6 is a top view illustrating a configuration of a structure according to a fourth embodiment. This structure has the same configuration as that of the structure according to the first embodiment, except that the third conductor pattern 400 has a concave portion 410 in the planar shape, and is connected to the interconnect-shaped connection conductor 500 at the bottom of the concave portion 410.

In the embodiment, the same effect as that of the first embodiment can also be obtained. In addition, since the connection conductor 500 can be lengthened, it is possible to increase $L_L$ in FIG. 3.

Figure 7:
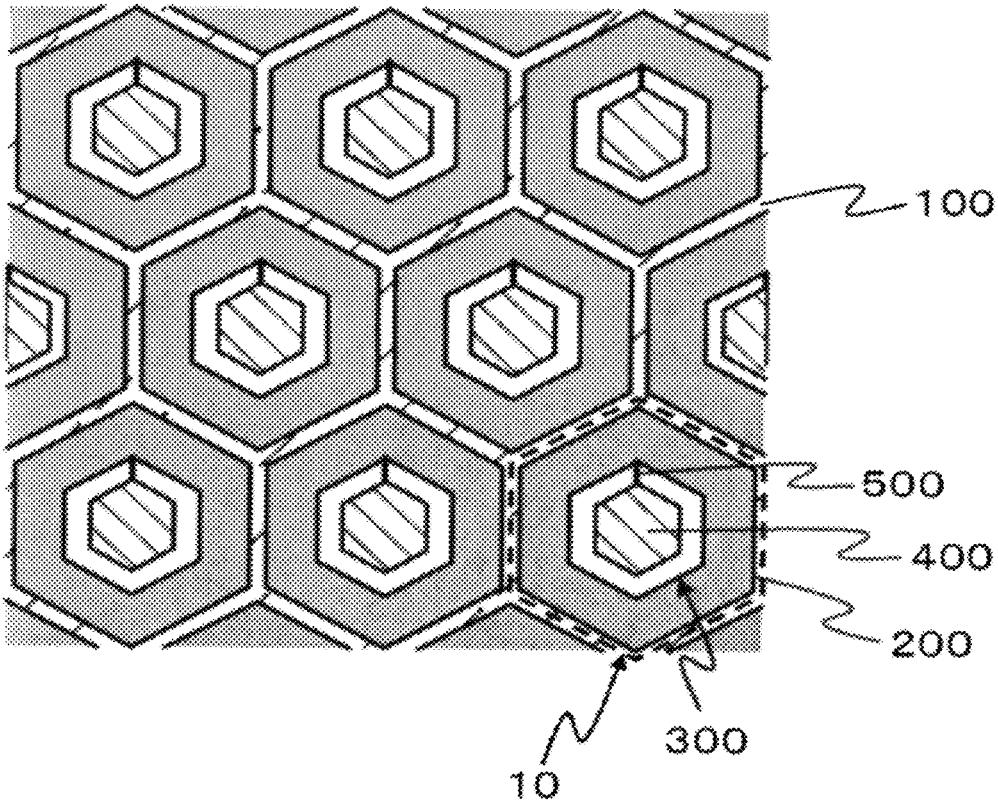
FIG. 7 is a top view illustrating a configuration of a structure according to a fifth embodiment.

FIG. 7 is a top view illustrating a configuration of a structure according to a fifth embodiment. This structure has the same configuration as that of the structure according to the first embodiment, except for the following points. First, the planar shape of the first conductor pattern 200 is regular hexagonal. The opening 300 and the third conductor pattern 400 also have a regular hexagonal shape. The first conductor pattern 200, the opening 300, and the third conductor pattern 400 are oriented in the same direction in a plan view, and are concentric with each other. The connection conductor 500 is connected to each of the corner of the opening 300 and the corner of the third conductor pattern 400.

In the embodiment, the same effect as that of the first embodiment can also be obtained. In addition, since the planar shape of the first conductor pattern 200 is regular hexagonal, it is possible to dispose the unit cells 10 in high density.

Figure 8:
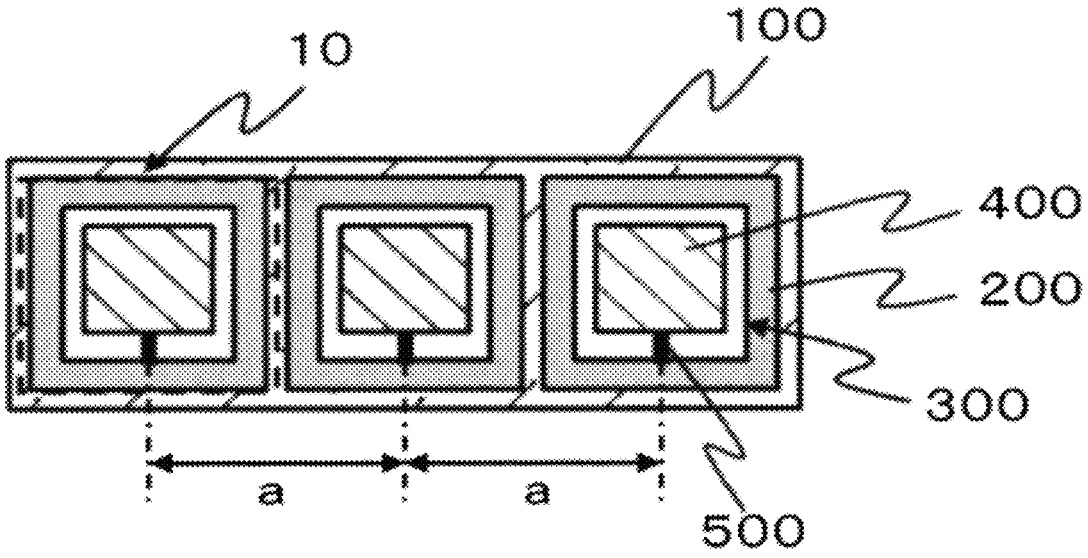
FIG. 8 is a top view illustrating a configuration of a structure according to a sixth embodiment.

FIG. 8 is a top view illustrating a configuration of a structure according to a sixth embodiment. This structure has the same configuration as those of the structures according to any of the first to fifth embodiments, except that the unit cells 10 have a one-dimensional array. The drawing illustrates the same configuration as that of the structure according to the first embodiment.

Specifically, a plurality of first conductor patterns 200 are arranged in a first direction (horizontal direction in the drawing). The connection conductors 500 are provided at regular intervals a and perpendicular to the first direction. One end of the connection conductor 500 is connected to the center of a side in the third conductor pattern 400 parallel to the first direction, and the other end is connected to the center of a side in the opening 300 parallel to the first direction.

In the embodiment, the same effect as that of the first embodiment can also be obtained. In addition, since the connection conductors 500 are provided at regular intervals a and perpendicular to the first direction, all the unit cells 10 are equivalent to each other in the first direction. As a result, a design of the structure is facilitated.

Figure 9:
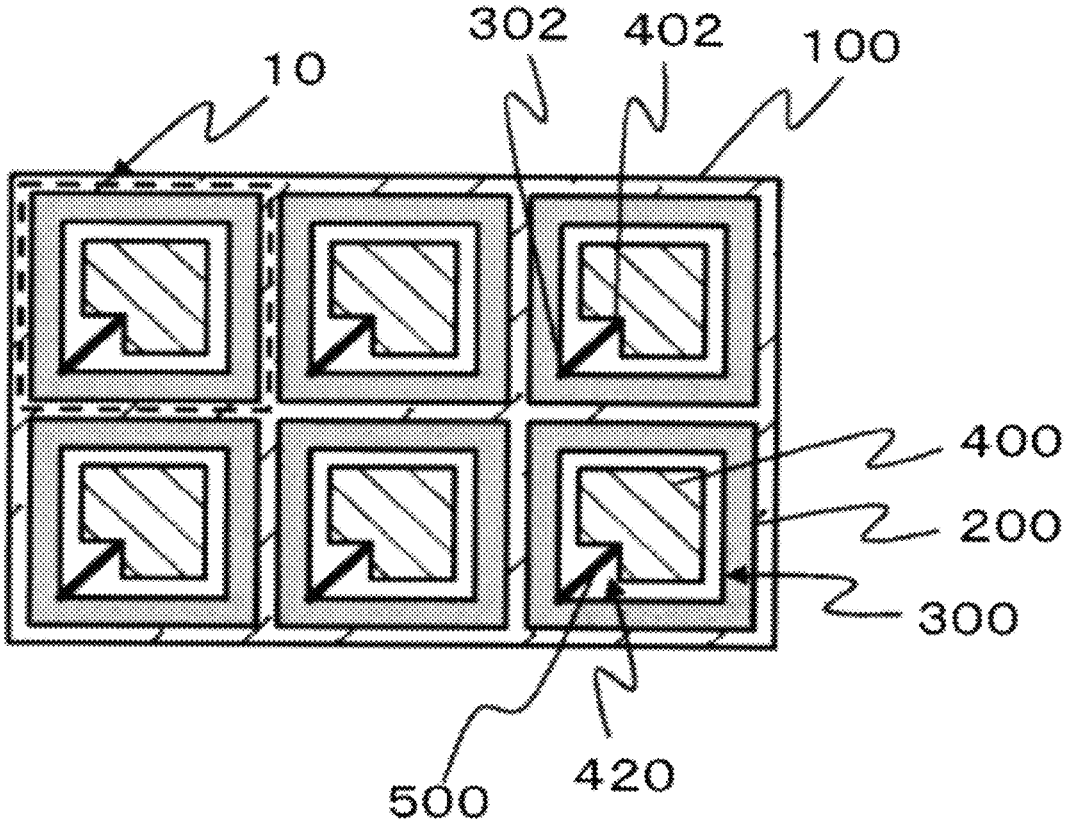
FIG. 9 is a top view illustrating a configuration of a structure according to a seventh embodiment.

FIG. 9 is a top view illustrating a configuration of a structure according to a seventh embodiment. This structure has the same configuration as that of the structure according to the first embodiment, except for the following points. First, similarly to the first embodiment, a plurality of first conductor patterns 200, the openings 300, and the third conductor patterns 400 are square, and are provided concentrically with each other in the same direction. In addition, the unit cells 10 have a two-dimensional array. The connection conductor 500 connects a first corner 302 corresponding to one corner of the opening 300 to a second corner 402 of the third conductor pattern 400 opposite the first corner 302. Meanwhile, all the unit cells 10 are oriented in the same direction.

In addition, in the embodiment, the third conductor pattern 400 has a notch 420 at the second corner 402. The notch 420 is square, and is oriented in the same direction as that of the third conductor pattern 400. The connection conductor 500 is connected to one of the corners newly formed by the notch 420 and farthest from the first corner 302.

In the embodiment, the same effect as that of the first embodiment can also be obtained. In addition, the connection conductor 500 connects the first corner 302 of the opening 300 to the second corner 402 opposite the first corner 302 in the third conductor pattern 400. For this reason, the unit cells 10 are equivalent to each other in any of the vertical direction and the transverse direction in the drawing. As a result, the structure is easily designed. In addition, when the notch 420 is provided, the connection conductor 500 can be lengthened, and thus it is possible to increase $L_L$ in FIG. 3.

Figure 10:
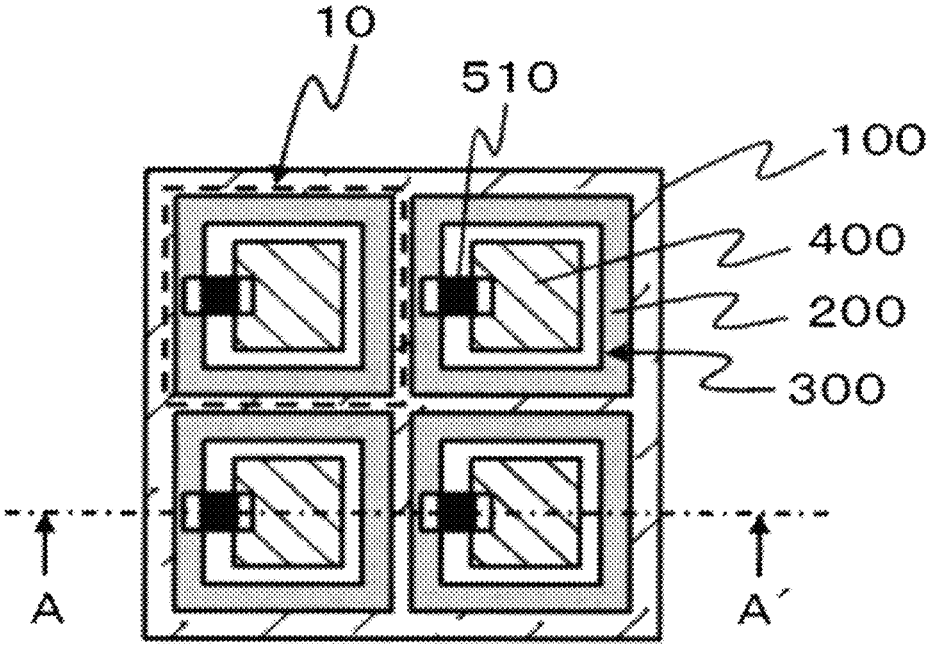
FIG. 10(*a*) is a top view illustrating a configuration of a structure according to an eighth embodiment, and FIG. 10(*b*) is a cross-sectional view taken along the line A-A' of FIG. 10(*a*).
Figure 10:
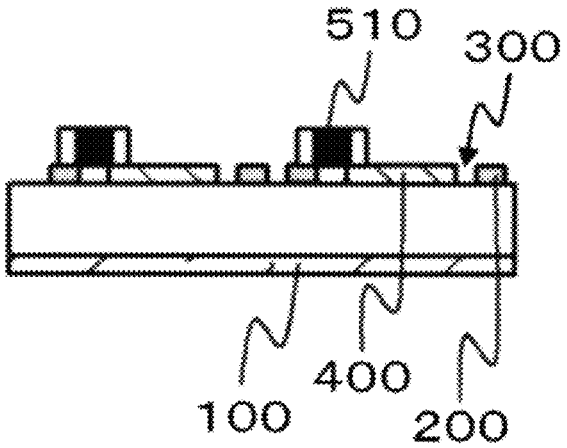

FIG. 10(*a*) is a top view illustrating a configuration of a structure according to an eighth embodiment, and FIG. 10(*b*) is a cross-sectional view taken along the line A-A' of FIG. 10(*a*). This structure has the same configuration as those of the structures according to any of the first to seventh embodiments, except that a chip inductor 510 is included instead of the interconnect-shaped connection conductor 500. FIG. 10 illustrates the same configuration as that of the structure according to the first embodiment.

A method of manufacturing the structure is the same as the method of manufacturing the structure according to the first embodiment, except for the following points. First, when a plurality of first conductor patterns 200, the openings 300, and the third conductor patterns 400 are formed, the connection conductor 500 is not formed. After a plurality of first conductor patterns 200, the openings 300, and the third conductor patterns 400 are formed, the first conductor pattern 200 and the third conductor pattern 400 are connected to each other using the chip inductor 510.

In the embodiment, the same effect as that of the first embodiment can also be obtained. In addition, the use of the chip inductor 510 makes it possible to increase $L_L$ in FIG. 3 even when the third conductor pattern 400 is not decreased.

Figure 11:
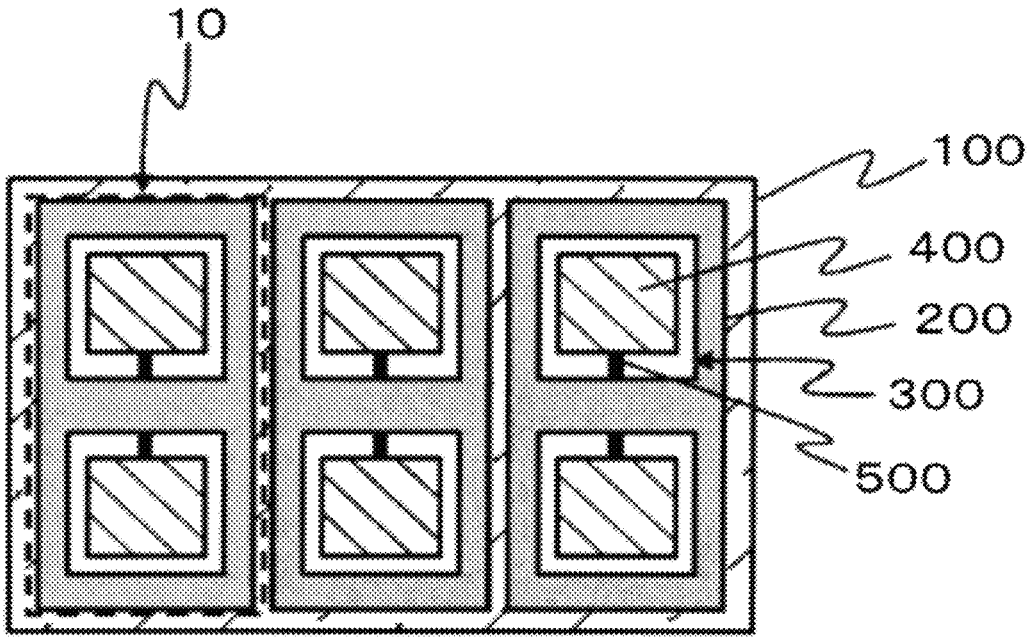
FIG. 11 is a plan view illustrating a configuration of a structure according to a ninth embodiment.

FIG. 11 is a top view illustrating a configuration of a structure according to a ninth embodiment. This structure has the same configuration as those of the structures according to any one of the first to eighth embodiments, except that one of the first conductor patterns 200 has plural sets of the openings 300, the third conductor patterns 400, and the connection conductors 500. FIG. 11 illustrates the same configuration as that of the structure according to the first embodiment.

In the example shown in the drawing, the first conductor pattern 200 is rectangular. Two sets of the openings 300, the third conductor patterns 400, and the connection conductors 500 are provided along the direction in which the long side of the first conductor pattern 200 extends. The opening 300 and the third conductor pattern 400 are square.

A plurality of unit cells 10 are disposed side by side in the direction in which the short side of the first conductor pattern 200 extends. The unit cells 10 are, for example, arranged in a one-dimensional array, but may be arranged in a two-dimensional array. When the unit cells 10 are arranged in a one-dimensional array, for example, electromagnetic waves propagate through the structure in the direction in which the short side of the first conductor pattern 200 extends. Two sets of the openings 300, the third conductor patterns 400, and the connection conductors 500 are disposed line-symmetrically with respect to the direction in which the short side of the first conductor pattern 200 extends.

In the embodiment, the same effect as that of the first embodiment can also be obtained. In addition, two sets of the openings 300, the third conductor patterns 400, and the connection conductors 500 are disposed line-symmetrically with respect to the direction in which the short side of the first conductor pattern 200 extends. For this reason, when the unit cells 10 are arranged in a one-dimensional array in the direction in which the short side of the first conductor pattern 200 extends, all the unit cells 10 are equivalent to each other in the arrangement direction. As a result, the structure is easily designed.

Figure 12:
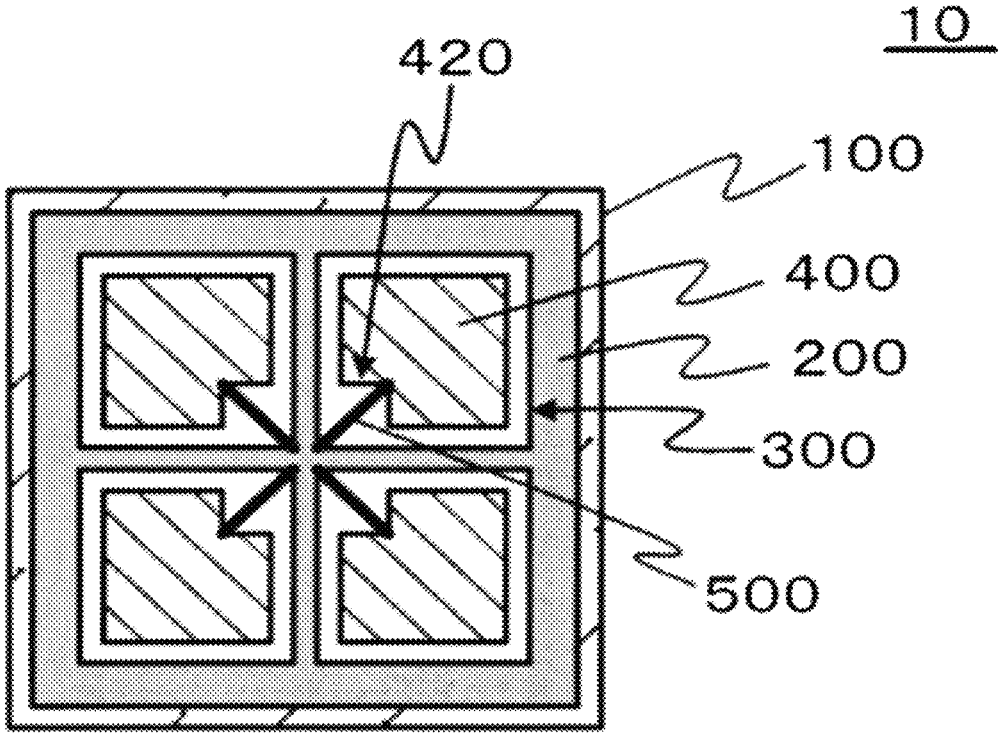
FIG. 12 is a top view illustrating a configuration of a structure according to a tenth embodiment.

FIG. 12 is a top view illustrating a configuration of a structure according to a tenth embodiment. This structure has the same configuration as that of the structure according to the ninth embodiment, except for the following points. First, three sets or more of the openings 300, the third conductor patterns 400, and the connection conductors 500 are arranged along one circle with respect to one of the first conductor patterns 200. Each of three or more connection conductors 500 extends in the direction passing through the center of the circle mentioned above. This center of the circle overlaps the center of the first conductor pattern 200. In the example shown in the drawing, four sets of the openings 300, the third conductor patterns 400, and the connection conductors 500 are disposed at intervals of 45 degrees with respect to one of the first conductor patterns 200.

In the embodiment, the same effect as that of the first embodiment can also be obtained. In addition, even when the unit cells 10 are arranged in a two-dimensional array, all the unit cells 10 are equivalent to each other in any of the vertical direction and the transverse direction in the drawing. As a result, the structure is easily designed.

Figure 13:
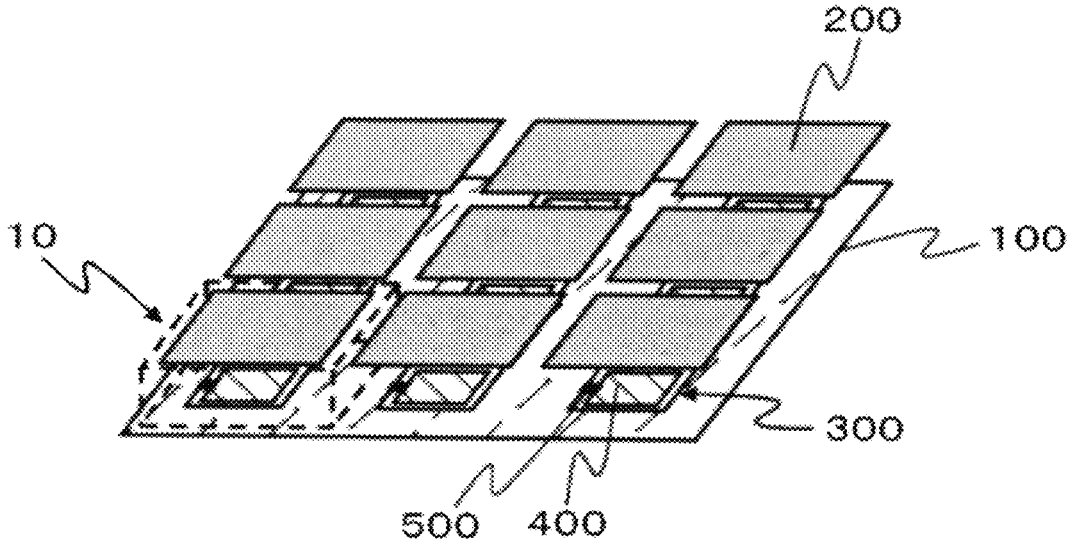
FIG. 13 is a perspective view illustrating a configuration of a structure according to an eleventh embodiment.
Figure 14:
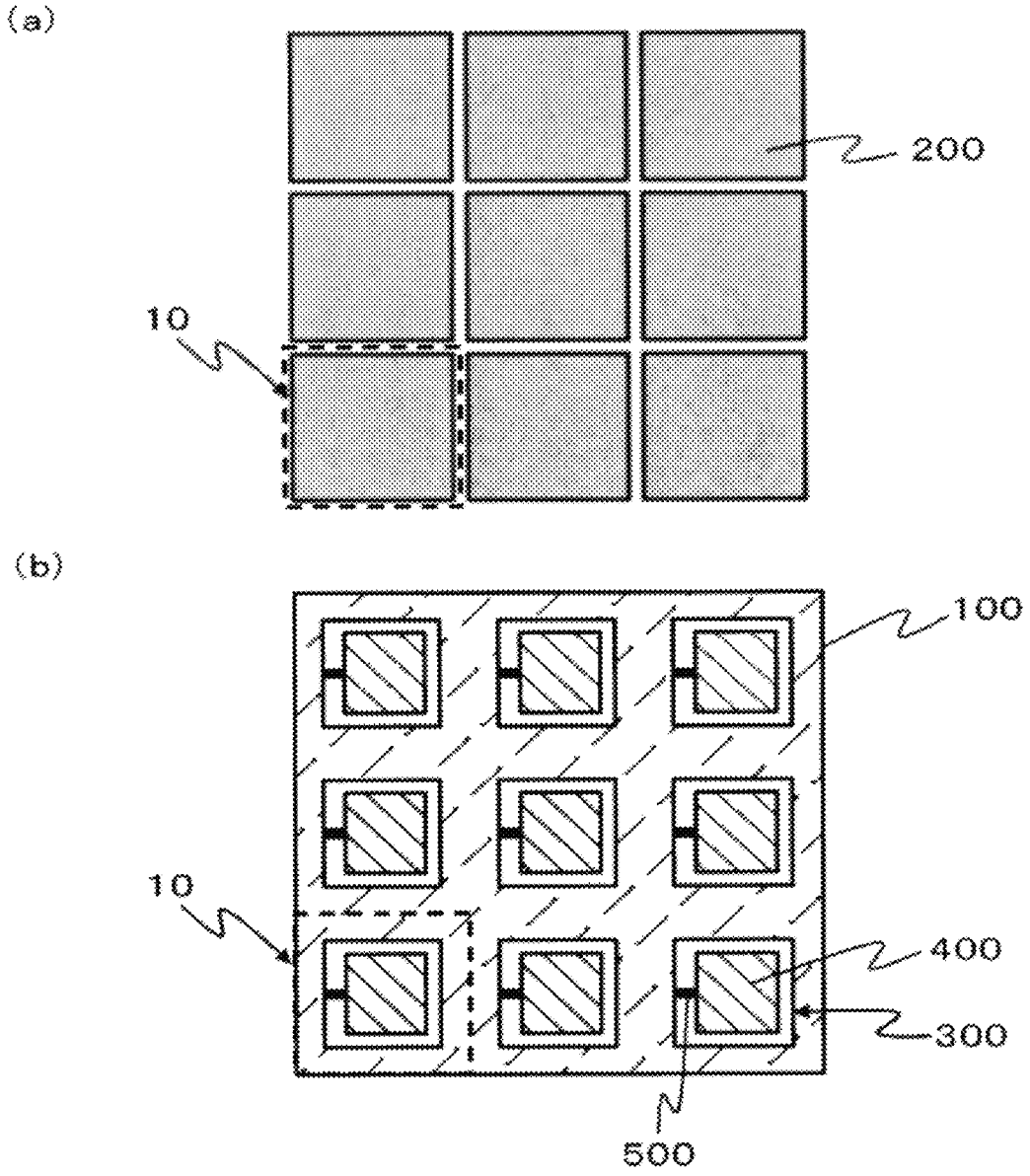
FIG. 14(*a*) is a plan view illustrating a first layer of the structure shown in FIG. 13, and FIG. 14(*b*) is a plan view illustrating a second layer of the structure shown in FIG. 13.

FIG. 13 is a perspective view illustrating a configuration of a structure according to an eleventh embodiment. FIG. 14(*a*) is a plan view illustrating a first layer of the structure shown in FIG. 13, and FIG. 14(*b*) is a plan view illustrating a second layer of the structure shown in FIG. 13. This structure has the same configuration as those of the structures according to any of the first to tenth embodiments, except that plural sets of the openings 300, the third conductor patterns 400, and the connection conductors 500 are provided in the second conductor pattern 100. FIG. 13 illustrates the same configuration as that of the structure according to the first embodiment.

In the embodiment, the opening 300 is provided opposite each of a plurality of first conductor patterns 200. The unit cell 10 is formed by the rectangular space including the first conductor pattern 200, the region in the second conductor pattern 100 opposite the first conductor pattern 200, the opening 300, the third conductor pattern 400, and the connection conductor 500.

In the embodiment, the same effect as that of the first embodiment can also be obtained.

Figure 15:
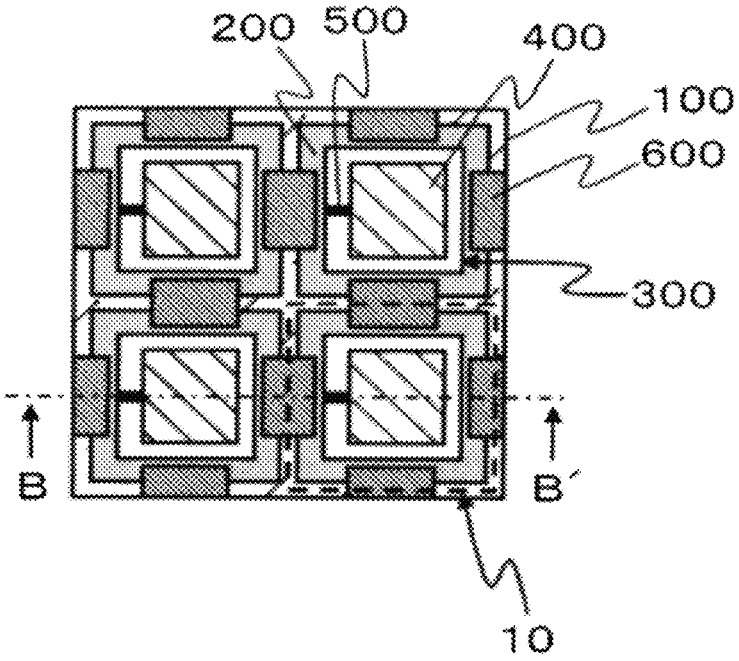
FIG. 15(*a*) is a top view illustrating a configuration of a structure according to a twelfth embodiment, and FIG. 15(*b*) is a cross-sectional view taken along the line B-B' of FIG. 15(*a*).
Figure 15:
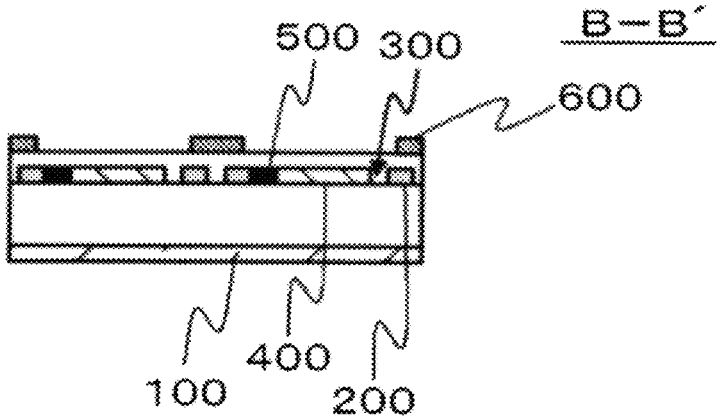

FIG. 15(*a*) is a top view illustrating a configuration of a structure according to a twelfth embodiment, and FIG. 15(*b*) is a cross-sectional view taken along the line B-B' of FIG. 15(*a*). This structure has the same configuration as those of the structures according to any of the first to eleventh embodiments, except that the structure includes a plurality of fourth conductor patterns 600 corresponding to a fourth conductor. FIG. 15 illustrates a case similar to the first embodiment.

A plurality of fourth conductor patterns 600 are insular electrode patterns provided in a third layer. The third layer is located opposite the second layer (layer in which the second conductor pattern 100 is provided) through the first layer (layer in which the first conductor pattern 200 is provided). The fourth conductor patterns 600 are arranged in a periodic pattern to straddle each of a plurality of first conductor patterns 200 in a plan view. That is, a first region of the fourth conductor pattern 600 overlaps the first conductor pattern 200, and a second region of the fourth conductor pattern 600 overlaps the first conductor pattern 200 located next to the first conductor pattern 200. The first region and the second region are equal to each other in area.

In the embodiment, the fourth conductor patterns 600 are rectangular, and are equal to each other in area. The fourth conductor patterns 600 have a line-symmetric planar shape with respect to the straight line extending between a plurality of first conductor patterns 200. In addition, the fourth conductor pattern 600 overlaps the center of any of the sides of the first conductor pattern 200.

Figure 16:
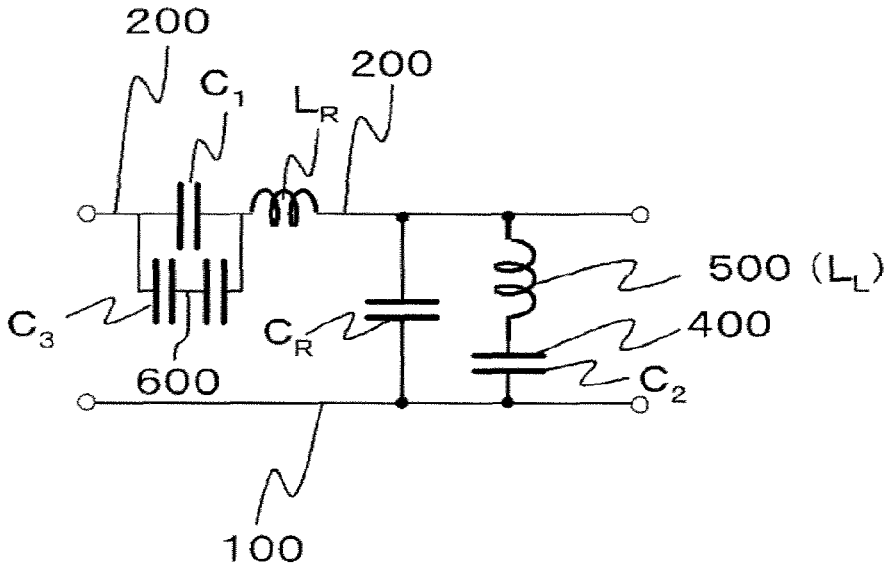
FIG. 16(*a*) is an equivalent circuit diagram illustrating the structure shown in FIG. 15, and FIG. 16(*b*) is a diagram for explaining a capacitor formed by a fourth conductor pattern 600.
Figure 16:
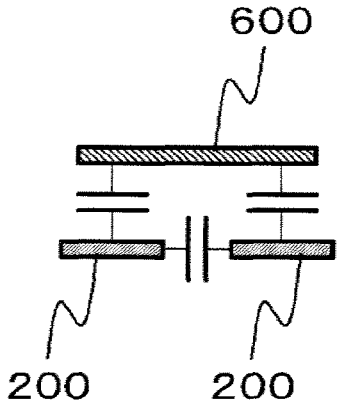

FIG. 16(*a*) is an equivalent circuit diagram of the structure shown in FIG. 15, and FIG. 16(*b*) is a diagram for explaining a capacitor formed by the fourth conductor pattern 600. As shown in FIG. 16(*a*), two first conductor patterns 200 adjacent to each other alone form the capacitance $C_1$. On the other hand, as mentioned above, the fourth conductor pattern 600 overlaps the first conductor pattern 200, and also overlaps the next first conductor pattern 200. For this reason, the fourth conductor pattern 600 forms a capacitance $C_3$ between each of two first conductor patterns 200 adjacent to each other. That is, the provision of the fourth conductor pattern 600 leads to increase in the capacitive component between two first conductor patterns 200 adjacent to each other as shown in two drawings of FIG. 16. As a result, it is possible to adjust the meta-material characteristics of the structure in a wider range.

Figure 17:
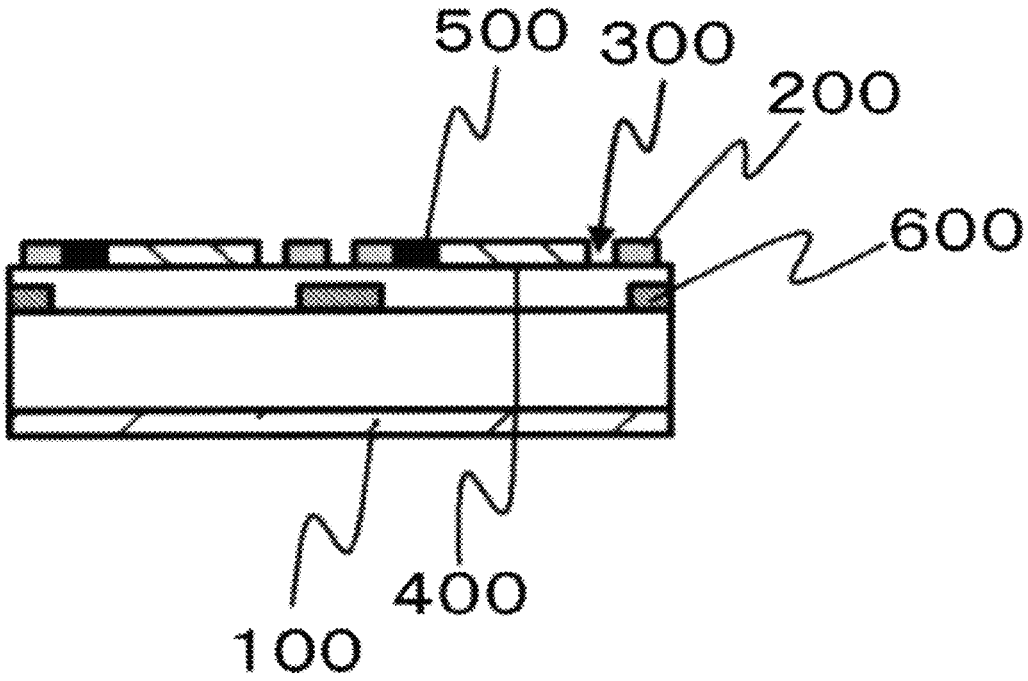
FIG. 17 is a diagram illustrating a first modified example of the structure shown in FIG. 15.

FIG. 17 is a diagram illustrating a first modified example of the structure shown in FIG. 15. This structure has the same configuration as that of the structure shown in FIG. 15, except that the third layer (layer in which the fourth conductor pattern 600 is provided) is located between the first layer (layer in which the first conductor pattern 200 is provided) and the second layer (layer in which the second conductor pattern 100 is provided). An equivalent circuit in this modified example is also the same as the equivalent circuit shown in FIG. 16.

Figure 18:
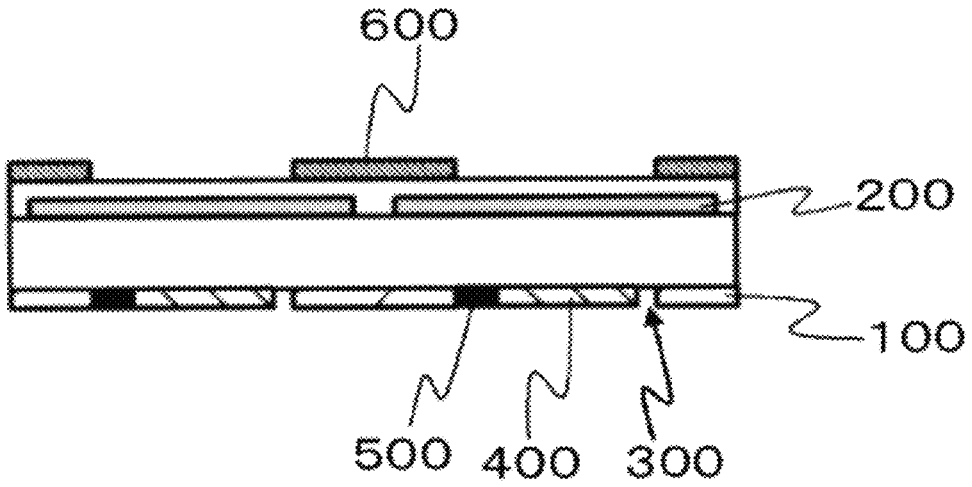
FIG. 18 is a diagram illustrating a second modified example of the structure shown in FIG. 15.

FIG. 18 is a diagram illustrating a second modified example of the structure shown in FIG. 15. This structure has a configuration in which the structure according to the eleventh embodiment is provided with the fourth conductor pattern 600 shown in FIG. 15. That is, this structure has the same configuration as that of the structure shown in FIG. 15, except that the second conductor pattern 100 is provided with the opening 300, the third conductor pattern 400, and the connection conductor 500. An equivalent circuit in the modified example is also the same as the equivalent circuit shown in FIG. 16.

Figure 19:
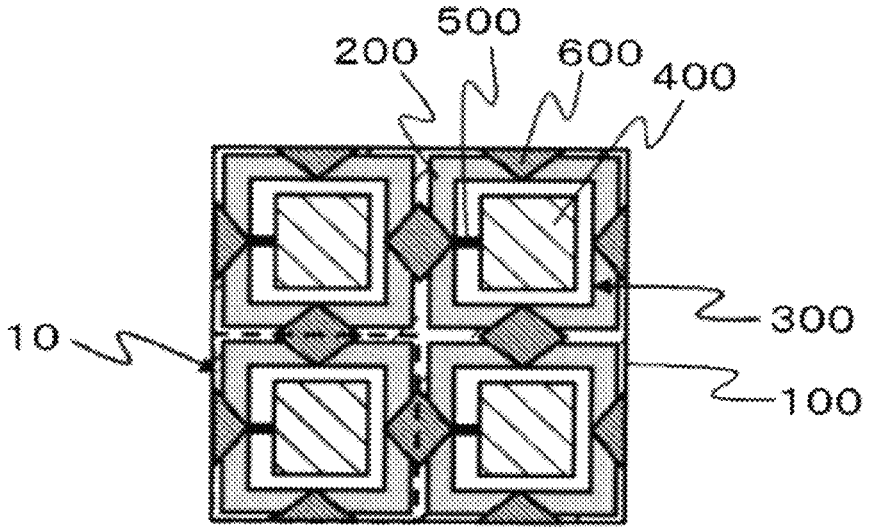
FIG. 19 is a diagram illustrating a third modified example of the structure shown in FIG. 15.
Figure 19:
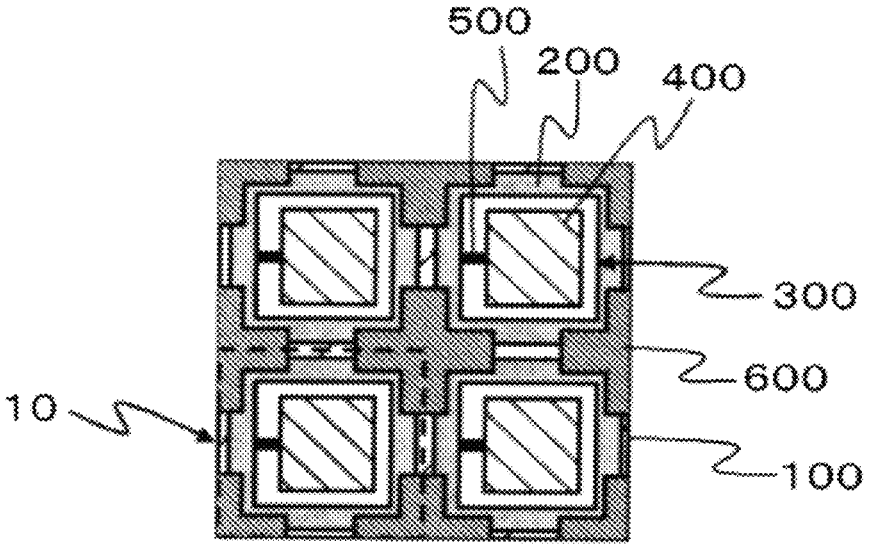

Each drawing of FIG. 19 is a diagram illustrating a third modified example of the structure shown in FIG. 15. This structure has a planar shape of the fourth conductor pattern 600 different from that in the example shown in FIG. 15. In the example shown in FIG. 19(*a*), the fourth conductor pattern 600 is rhombic, and overlaps the center of any of the sides of the first conductor pattern 200. In addition, in the example shown in FIG. 19(*b*), the fourth conductor patterns 600 are cross-shaped, and overlap each other for each of the same areas as each first conductor pattern 200, in four first conductor patterns 200 made of two rows and two columns.

Figure 20:
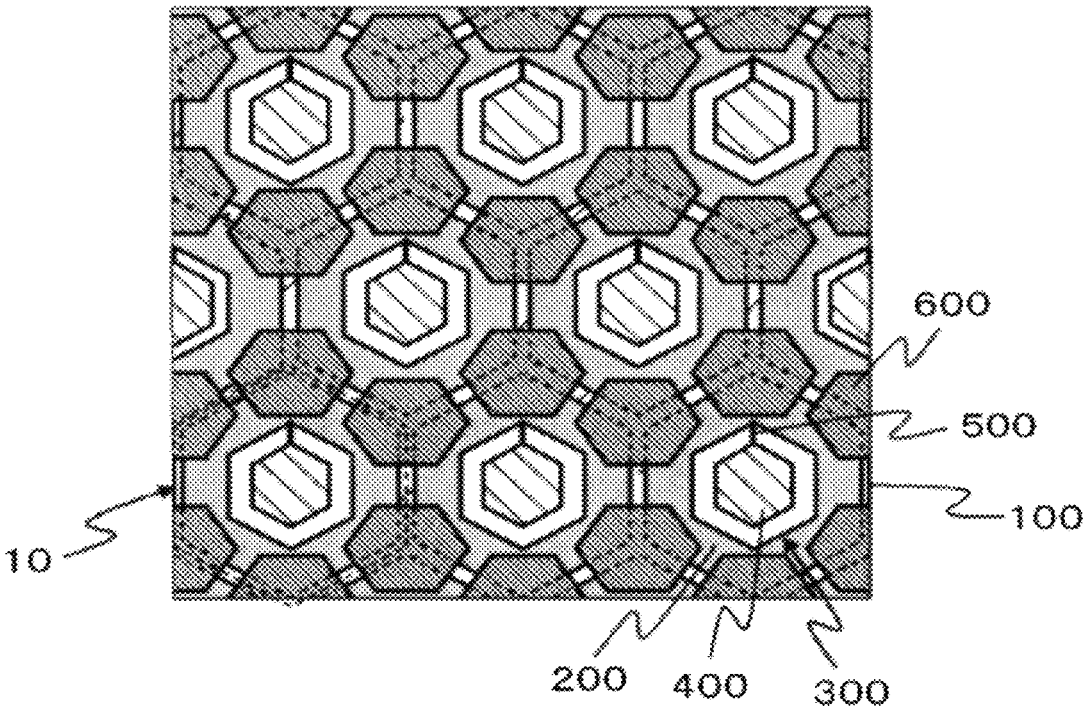
FIG. 20 is a diagram illustrating a fourth modified example of the structure shown in FIG. 15.

FIG. 20 is a diagram illustrating a fourth modified example of the structure shown in FIG. 15. This structure has a configuration in which the structure according to the fifth embodiment is provided with the fourth conductor pattern 600. The fourth conductor patterns 600 are regular hexagonal. Each of the fourth conductor patterns 600 is formed to overlap three first conductor patterns 200 of which the tops are adjacent to each other, and these overlapping areas are the same in size as each other.

According to the embodiment, as shown in two drawings of FIG. 16, the capacitive component between two first conductor patterns 200 adjacent to each other increases. For this reason, it is possible to adjust the meta-material characteristics of the structure in a wider range.

Figure 21:
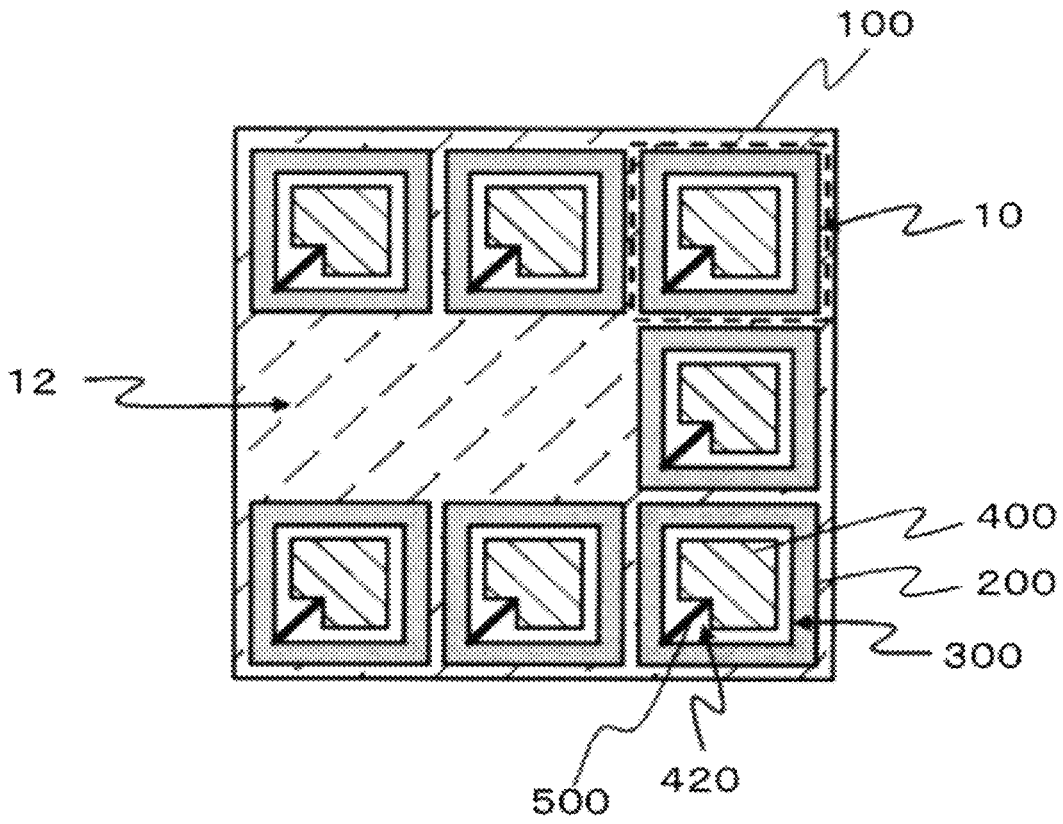
FIG. 21 is a diagram illustrating an example in which the structure has a lattice defect.
Figure 22:
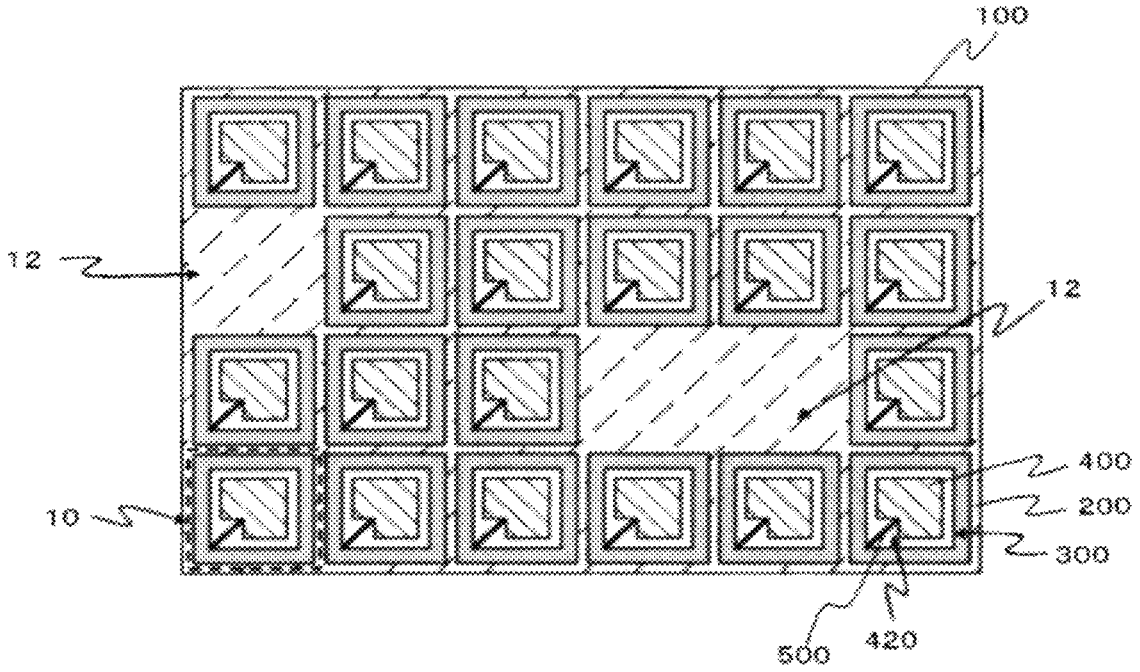
FIG. 22 is a diagram illustrating an example in which the structure has lattice defects.

Meanwhile, in the first to fifth embodiments and the seventh to twelfth embodiments, there may be a portion not including the unit cells 10, and for example, as shown in FIGS. 21 and 22, the structure may be configured to have a lattice defect 12. For example, in the example shown in FIG. 21, the unit cells 10 are not partially provided, and thus the array of the unit cells 10 is a one-dimensional array having a bending portion. In the example shown in FIG. 22, in at least one lattice defect 12, its perimeter is surrounded by the unit cells 10. Meanwhile, in any of the examples shown in FIGS. 21 and 22, a hole vertically penetrating through the structure may be provided in the portion provided with the lattice defect 12. In this case, a through via is provided through this hole, and an interconnect located below the structure is connected to an interconnect located above the structure.

Figure 23:
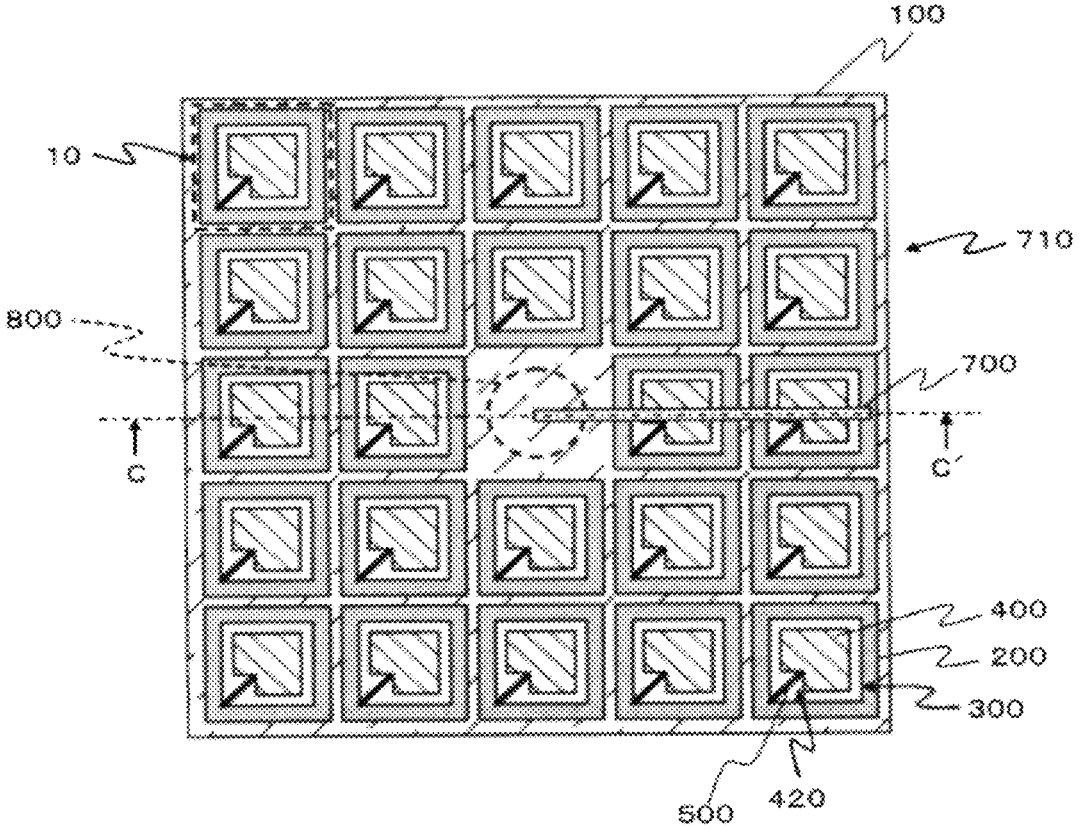
FIG. 23 is a plan view illustrating a configuration of an antenna according to a thirteenth embodiment.
Figure 24:
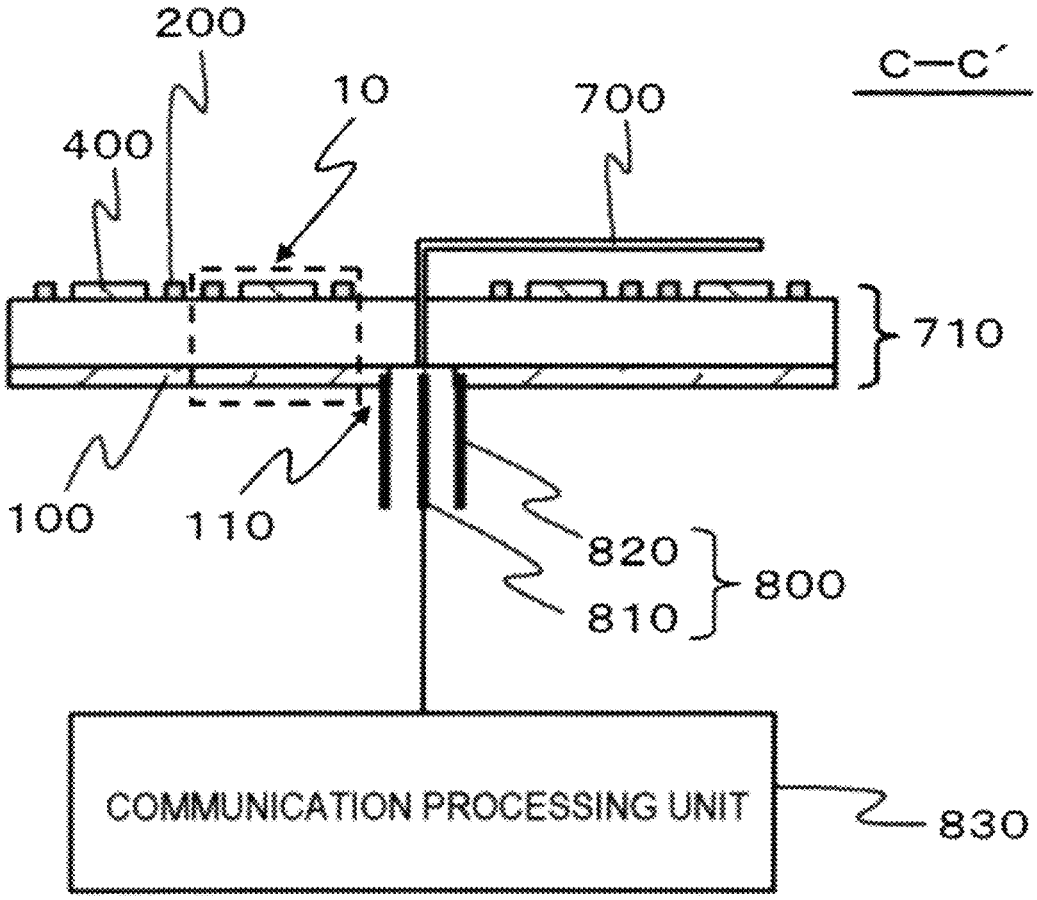
FIG. 24 is a cross-sectional view taken along the line C-C' of FIG. 23.

FIG. 23 is a plan view illustrating a configuration of an antenna according to a thirteenth embodiment, and FIG. 24 is a cross-sectional view taken along the line C-C' of FIG. 23.

This antenna includes an antenna element 700, and a reflective plate 710 provided opposite the antenna element 700. The reflective plate 710 is formed of the structure according to any of the first to twelfth embodiments. In the example shown in the drawing, the structure has the structure according to the seventh embodiment.

In the embodiment, the structure is used as an EBG structure. The frequency at which the antenna element 700 performs communication is included in a stop band (band gap) of the structure. The antenna shown in FIGS. 23 and 24 is an inverted L antenna. The antenna element 700 is disposed opposite the first conductor pattern 200, the opening 300, the third conductor pattern 400, and the connection conductor 500.

In this case, electromagnetic waves emitted from the antenna element 700 are reflected in-phase from the reflective plate 710. In this condition, the radiation efficiency of the antenna is highest when the antenna element 700 is disposed in proximity to the surface of the reflective plate 710. As a result, if the antenna element 700 is disposed opposite the first conductor pattern 200 of the reflective plate 710, the thickness of the inverted L-type antenna is allowed to be reduced.

Meanwhile, in this antenna, a coaxial cable 800 serving as a feed line is connected to the back side of the reflective plate 710. Specifically, the second conductor pattern 100 of the reflective plate 710 is provided with an opening 110. The coaxial cable 800 is installed in the opening 110. The opening 110 is located at a region in which the first conductor pattern 200 is not provided in a plan view. An internal conductor 810 of the coaxial cable 800 is connected to the antenna element 700 through the opening 110. The antenna element 700 extends upward above a layer provided with the second conductor pattern 100, through the region in which the first conductor pattern 200 is not provided in a plan view. An external conductor 820 of the coaxial cable 800 is connected to the second conductor pattern 100.

It is possible to form a communication device by connecting the coaxial cable 800 to a communication processing unit 830.

Figure 25:
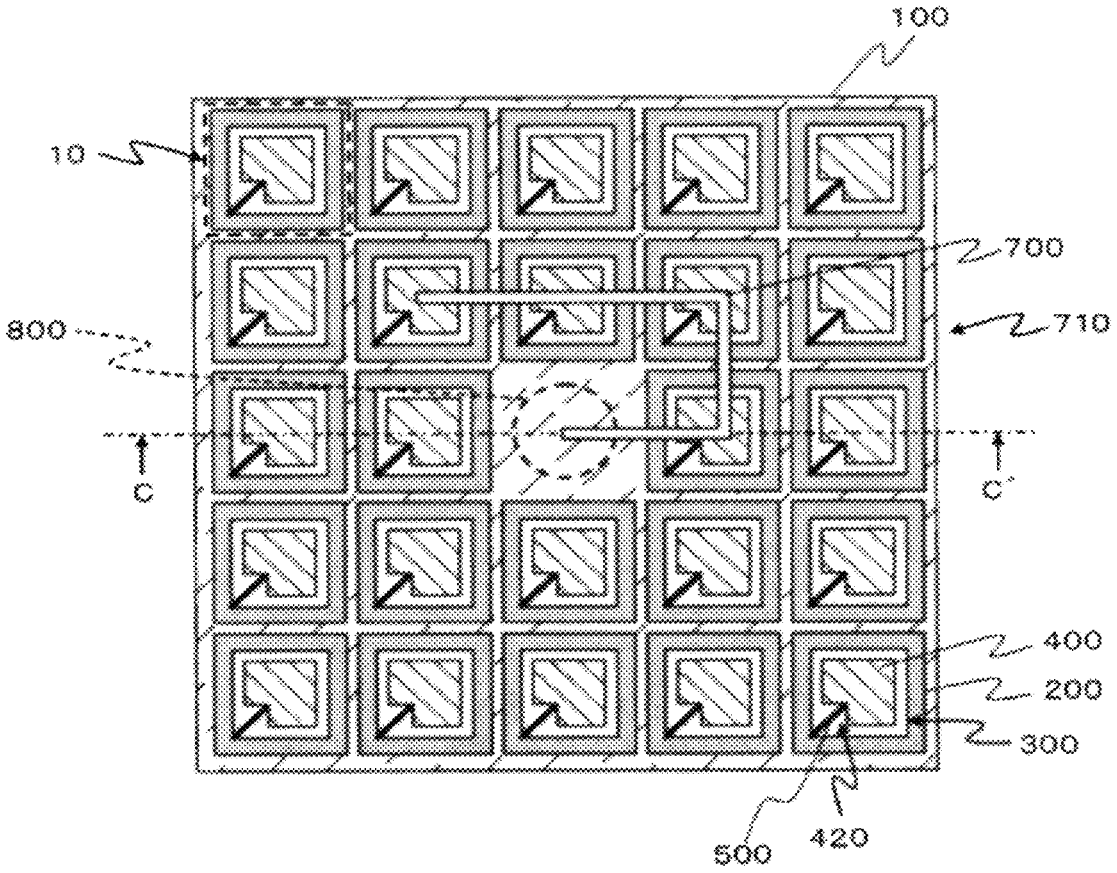
FIG. 25 is a plan view illustrating a first modified example of the antenna shown in FIGS. 23 and 24.

FIG. 25 is a plan view illustrating a first modified example of the antenna shown in FIGS. 23 and 24. As shown in the drawing, the antenna element 700 is not necessarily linear, but may be bent halfway.

Figure 26:
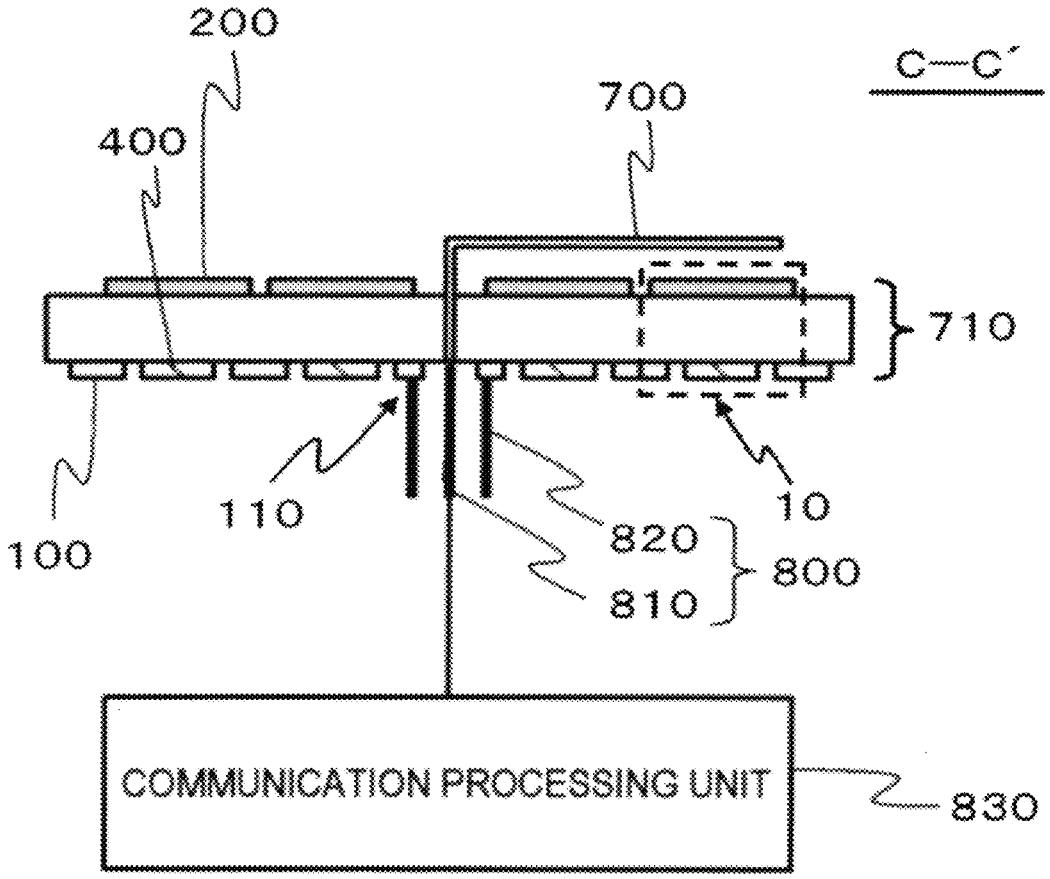
FIG. 26 is a cross-sectional view illustrating a second modified example of the antenna shown in FIGS. 23 and 24.

FIG. 26 is a cross-sectional view illustrating a second modified example of the antenna shown in FIGS. 23 and 24. In the example shown in the drawing, the reflective plate 710 has the same configuration as that of the structure according to the eleventh embodiment. That is, plural sets of the openings 300, the third conductor patterns 400, and the connection conductors 500 are provided in the second conductor pattern 100. The antenna element 700 is disposed opposite the first conductor pattern 200.

Figure 27:
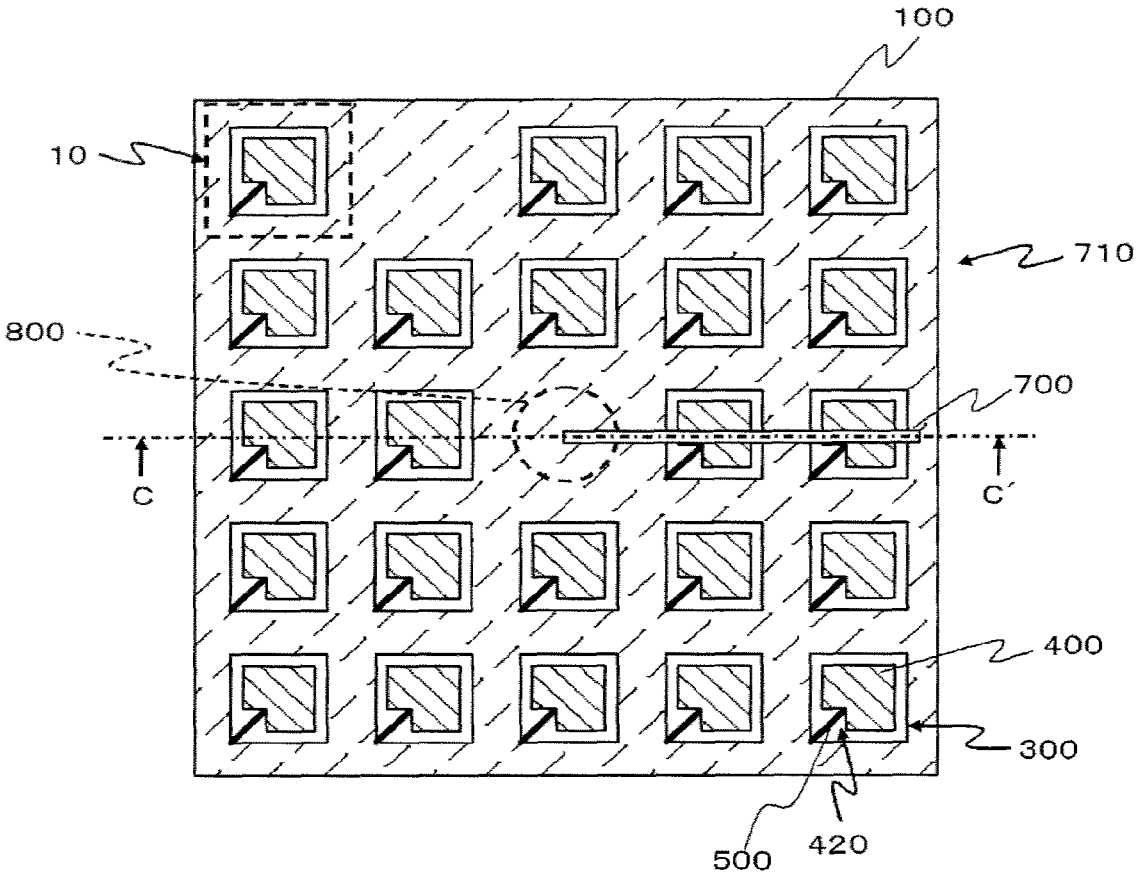
FIG. 27 is a plan view illustrating a third modified example of the antenna shown in FIGS. 23 and 24.
Figure 28:
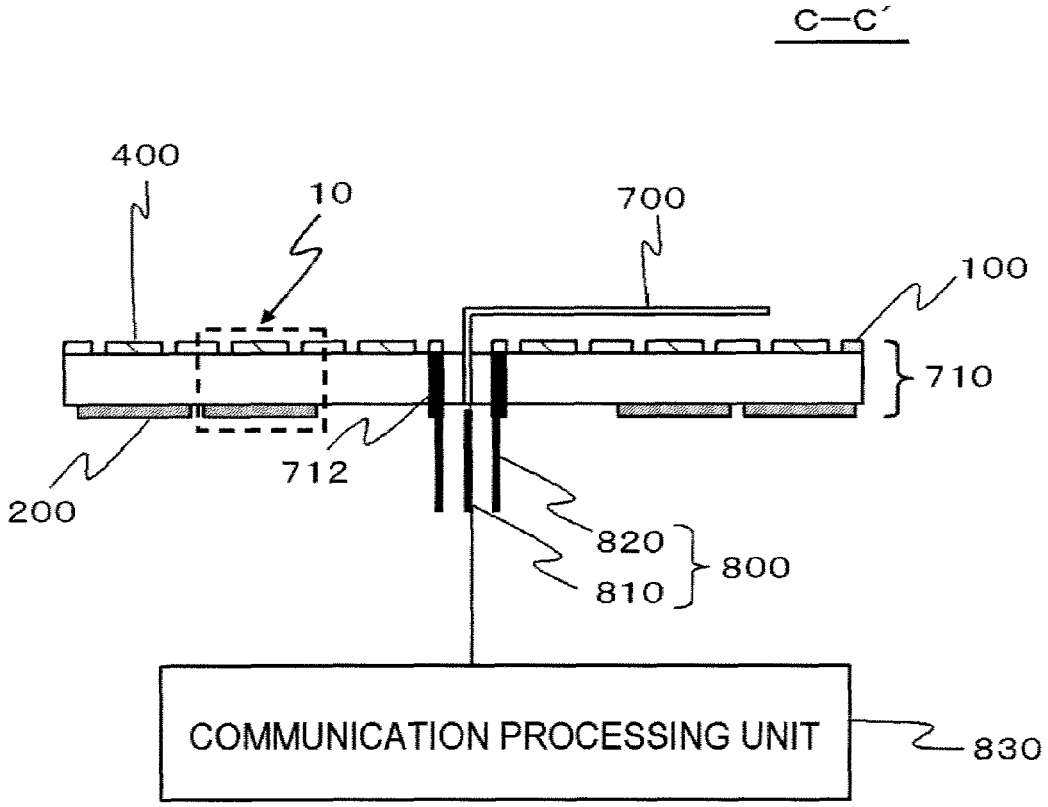
FIG. 28 is a cross-sectional view taken along the line C-C' of FIG. 27.

FIG. 27 is a plan view illustrating a third modified example of the antenna shown in FIGS. 23 and 24. FIG. 28 is a cross-sectional view taken along the line C-C' of FIG. 27. This antenna has the same configuration as that of the antenna shown in FIGS. 26 and 27, except that the reflective plate 710 is disposed in the direction in which the second conductor pattern 100 and the antenna element 700 face each other. The external conductor 820 of the coaxial cable 800 is connected to the second conductor pattern 100 through a through electrode 712 provided in the reflective plate 710.

According to the embodiment, since the gap between the reflective plate 710 and the antenna element 700 of the antenna can be narrowed, it is possible to reduce the thickness of the antenna. Such an effect is obtained even when any of the EBGs shown in the first to twelfth embodiments is used as the reflective plate 710.

Figure 29:
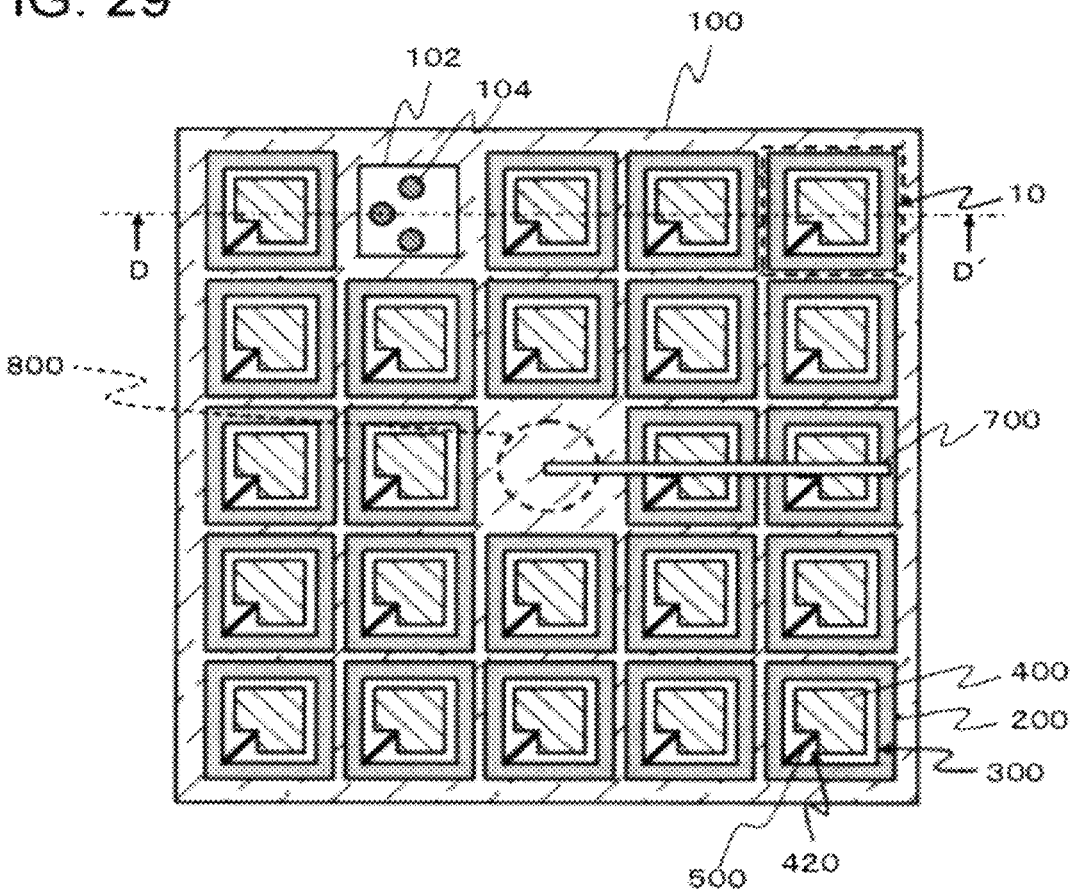
FIG. 29 is a plan view illustrating a configuration of an antenna according to a fourteenth embodiment.
Figure 30:
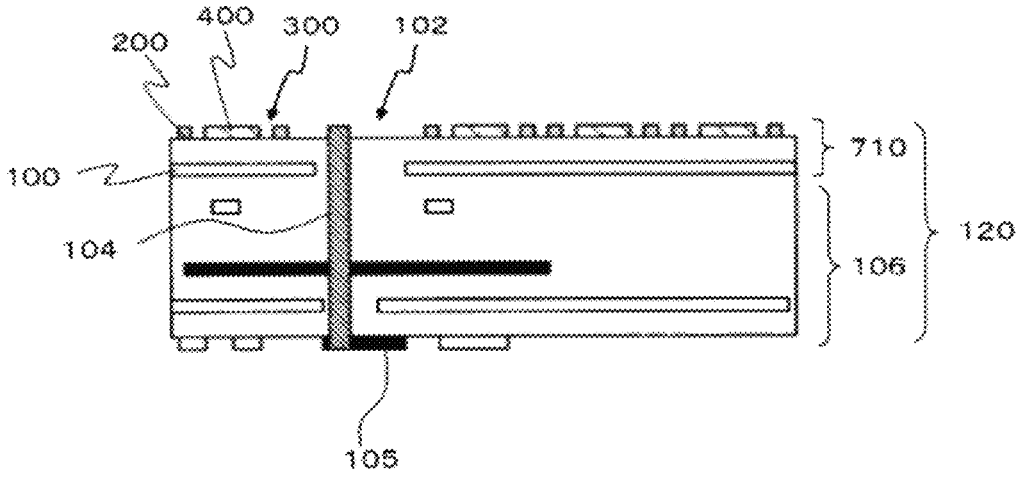
FIG. 30 is a cross-sectional view taken along the line D-D' of FIG. 29.

FIG. 29 is a plan view illustrating a configuration of an antenna according to a fourteenth embodiment, and FIG. 30 is a cross-sectional view taken along the line D-D of FIG. 29. This antenna has the same configuration as that of the antenna according to the thirteenth embodiment, except for the following points. First, in the reflective plate 710, a lattice defect is present in a lattice constituted by the unit cell 10. That is, in a plan view, the reflective plate 710 has a region in which the unit cell 10 is not provided. The second conductor pattern 100 located at the region is provided with an opening 102.

In addition, as shown in FIG. 30, the reflective plate 710 is formed using the upper portion of a multilayer substrate 120. The substrate 120 is, for example, a printed circuit board. The first conductor pattern 200, the third conductor pattern 400, and the connection conductor 500 are provided in an interconnect layer on the surface. The second conductor pattern 100 is provided in an interconnect layer closest to the surface in an internal interconnect layer. The substrate 120 includes other interconnects, for example, interconnects having no direct relation with the structure of the antenna, in a layer 106 located below the second conductor pattern 100.

The substrate 120 includes a via 104. One end of the via 104 reaches the surface of the substrate 120, and is connected to an interconnect (not shown) provided in the interconnect layer on the surface. In the example shown in the drawing, the via 104 penetrates through the substrate 120. The other end of the via 104 is connected to a line 105 provided in the back side of the substrate 120. Nevertheless, the other end of the via 104 may be connected to an interconnect provided in the internal interconnect layer of the substrate 120.

In the embodiment, the same effect as that of the thirteenth embodiment can also be obtained. In addition, since, in the reflective plate 710, there is a portion in which the unit cell 10 is not provided but the via 104 is provided in the portion, the degree of freedom in the design of the interconnect in the substrate 120 increases.

Figure 31:
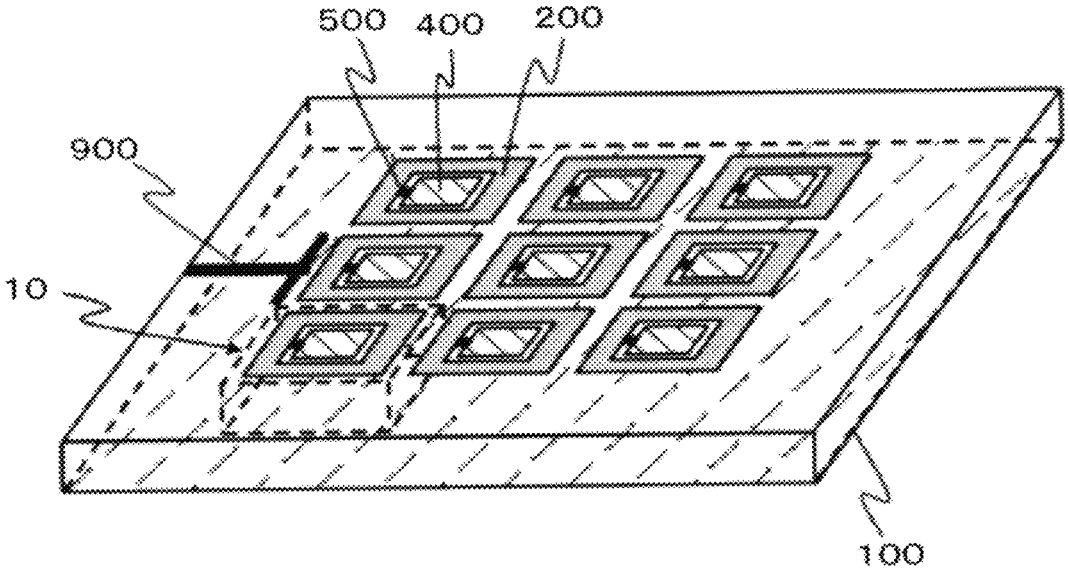
FIG. 31 is a perspective view illustrating a configuration of an antenna according to a fifteenth embodiment.
Figure 32:
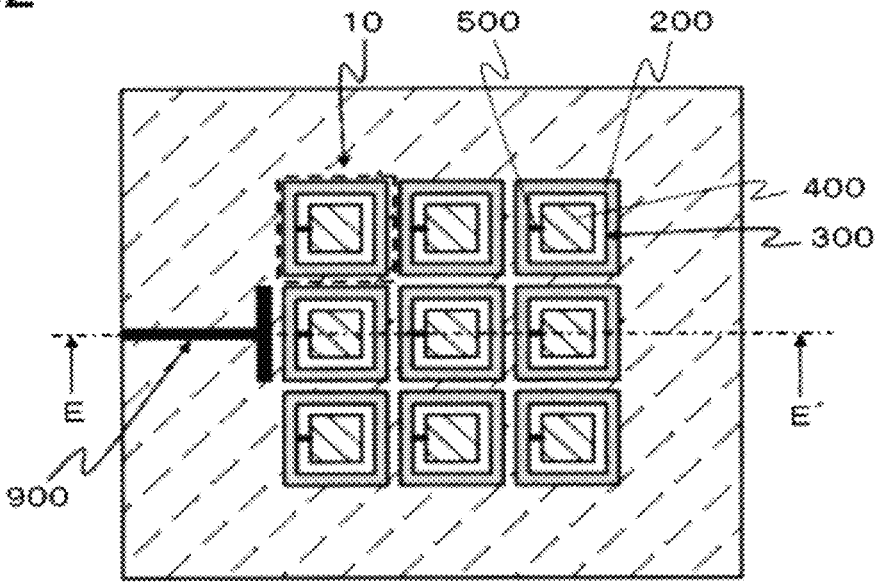
FIG. 32(*a*) is a top view illustrating the antenna shown in FIG. 31, and FIG. 32(*b*) is a cross-sectional view taken along the line E-E' of FIG. 32(*a*).
Figure 32:
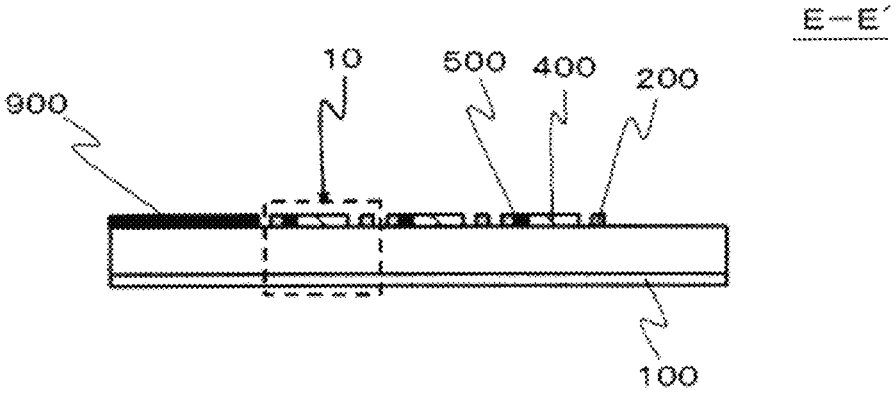

FIG. 31 is a perspective view illustrating a configuration of an antenna according to a fifteenth embodiment. FIG. 32(*a*) is a top view illustrating the antenna shown in FIG. 31. FIG. 32(*b*) is a cross-sectional view taken along the line E-E' of FIG. 32(*a*). This antenna is a resonator-type antenna, and a resonator is formed of the structure according to any of the first to twelfth embodiments. In the example shown in the drawing, resonator is formed of the structure according to the first embodiment. That is, in the frequency at which the antenna element 700 performs communication, the structure functions as a so-called left-handed-system meta-material.

In the embodiment, the antenna includes a feed line 900. The feed line 900 is provided on the same layer as the first conductor pattern 200 (that is, the first layer), and is capacitively coupled to one of the first conductor patterns 200.

The second conductor pattern 100 is provided also below the feed line 900. The feed line 900 and a region located below the feed line 900 in the second conductor pattern 100 constitute a microstrip line.

According to the embodiment, since the resonator of the resonance-type antenna is formed of the structure functioning as a left-handed-system meta-material, it is possible to miniaturize the antenna. Such an effect is obtained even when any of the structures according to the first to twelfth embodiments is used as the structure.

Figure 33:
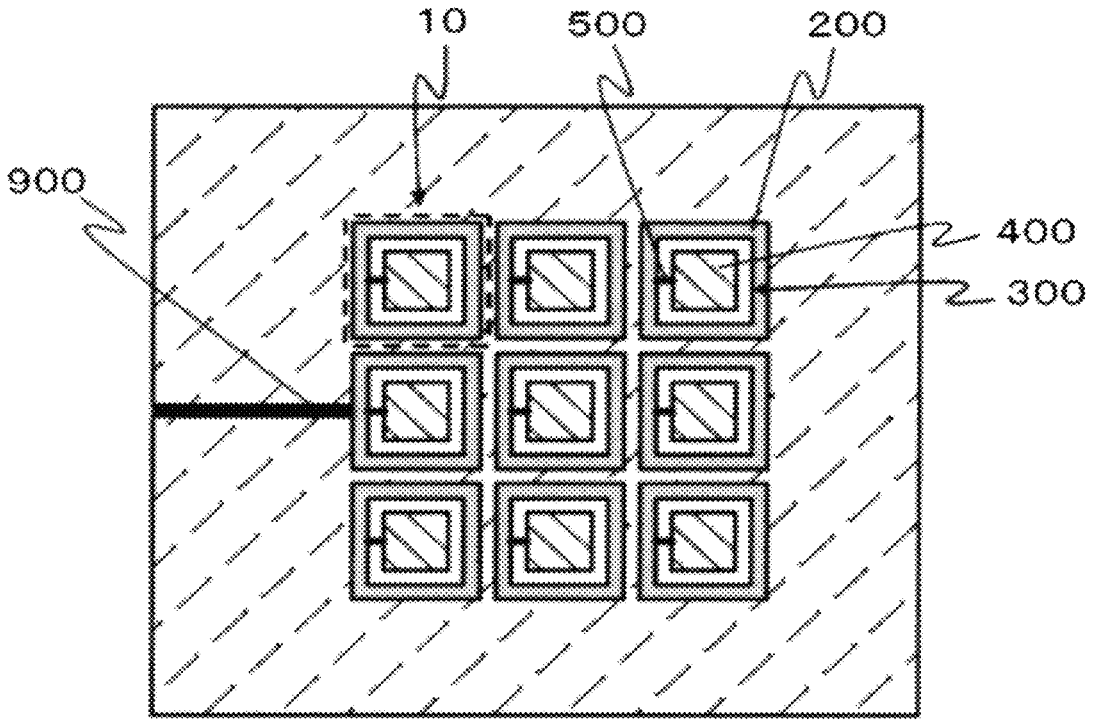
FIG. 33 is a top view illustrating a configuration of an antenna according to a sixteenth embodiment.

FIG. 33 is a top view illustrating a configuration of an antenna according to a sixteenth embodiment. This antenna has the same configuration as that of the antenna according to the fifteenth embodiment, except that the feed line 900 is directly connected to the first conductor pattern 200.

In the embodiment, the same effect as that of the fifteenth embodiment can also be obtained.

Figure 34:
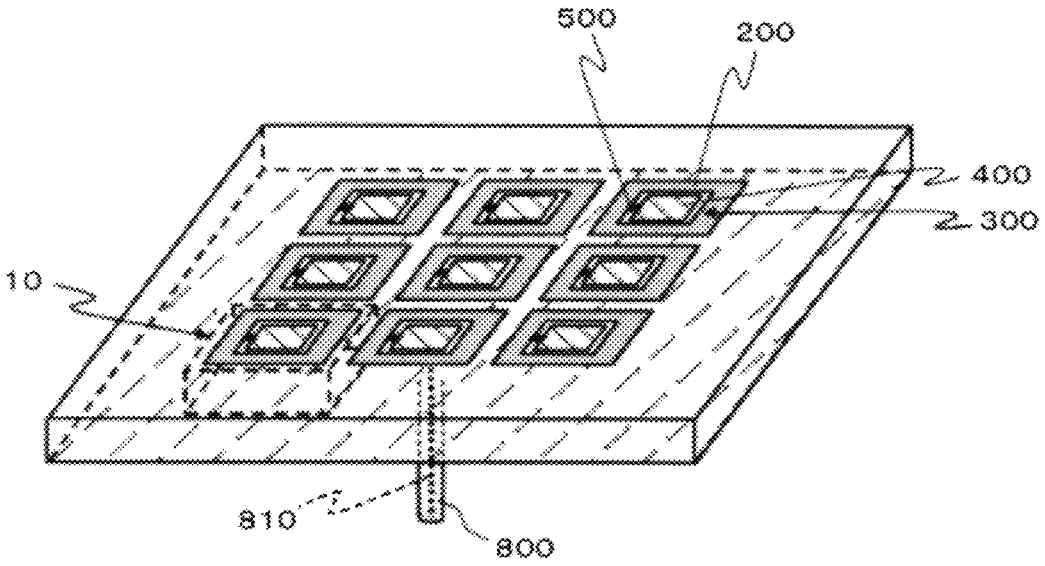
FIG. 34 is a perspective view illustrating a configuration of an antenna according to a seventeenth embodiment.

FIG. 34 is a perspective view illustrating a configuration of an antenna according to a seventeenth embodiment. This antenna has the same configuration as that of the antenna according to the fifteenth embodiment, except that the coaxial cable 800 is provided instead of the feed line 900. The coaxial cable 800 is connected to the surface of the structure provided with the second conductor pattern 100. Specifically, similarly to the example shown in FIG. 24, the second conductor pattern 100 is provided with an opening, and the coaxial cable 800 is installed in this opening. The internal conductor 810 of the coaxial cable 800 is connected to the first conductor pattern 200 through a through via provided in a region overlapping the opening. The external conductor of the coaxial cable 800 is connected to the second conductor pattern 100.

In the embodiment, the same effect as that of the fifteenth embodiment can also be obtained.

Figure 35:
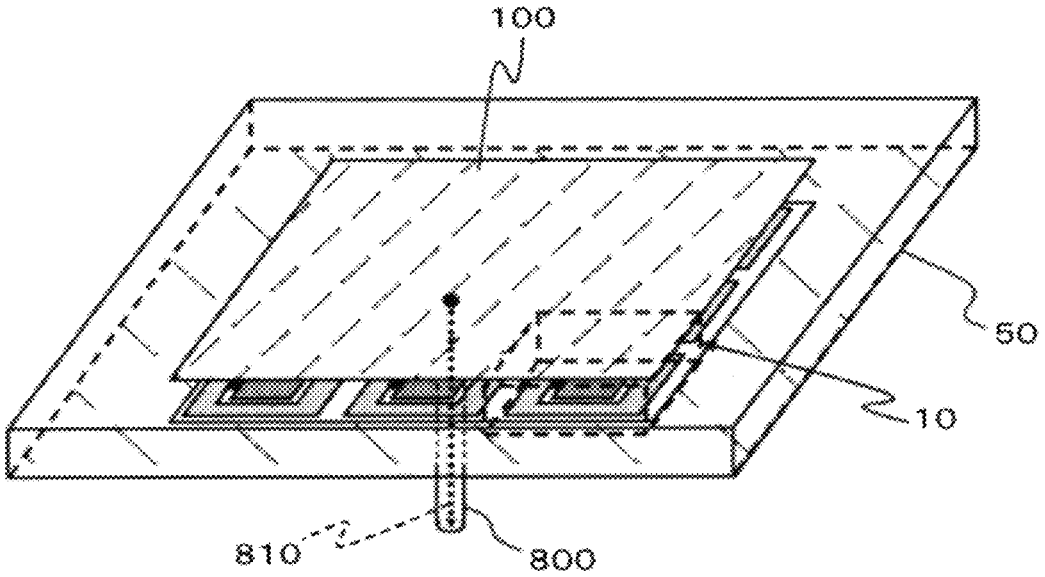
FIG. 35 is a perspective view illustrating a configuration of an antenna according to an eighteenth embodiment.
Figure 36:
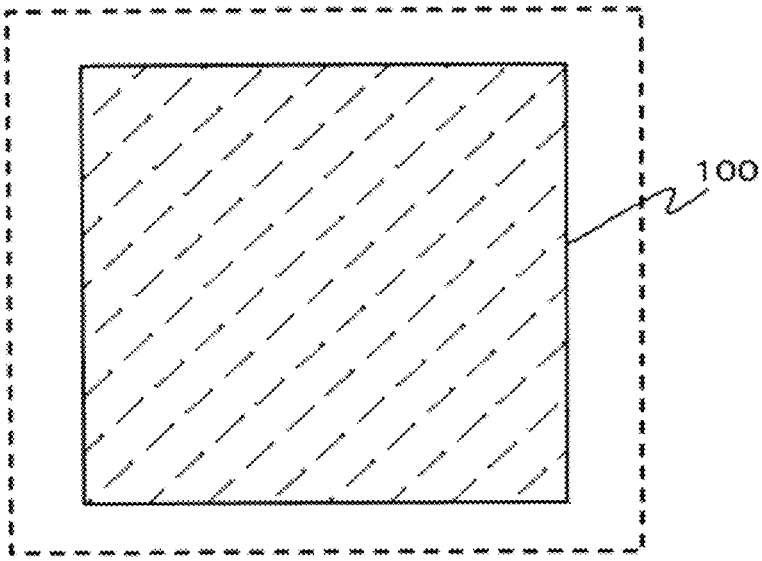
FIG. 36(*a*) is a plan view illustrating a configuration of a second layer of the antenna shown in FIG. 35, and FIG. 36(*b*) is a plan view illustrating a configuration of a first layer.
Figure 36:
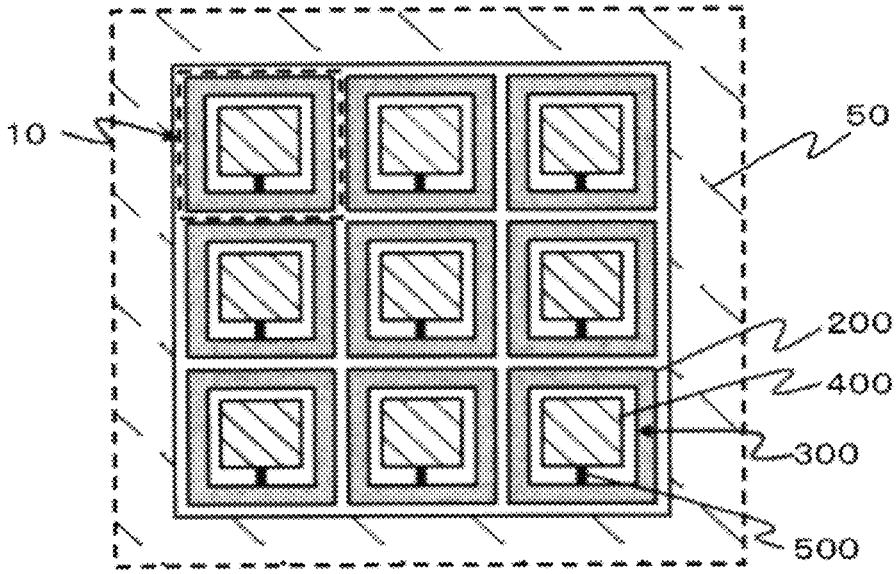

FIG. 35 is a perspective view illustrating a configuration of an antenna according to an eighteenth embodiment. FIG. 36(*a*) is a plan view illustrating a configuration of a layer (second layer) in which the second conductor pattern 100 of the antenna shown in FIG. 35 is provided. FIG. 36(*b*) is a plan view illustrating a configuration of a layer (first layer) in which the first conductor pattern 200 of the antenna shown in FIG. 35 is provided.

This antenna has the same configuration as that of the antenna according to the sixteenth embodiment, except that the coaxial cable 800 is connected to the surface of the structure provided with the first conductor pattern 200. In the embodiment, the coaxial cable 800 is connected to a region in which the first conductor pattern 200 is not provided in a plan view. The internal conductor 810 of the coaxial cable 800 is connected to the second conductor pattern 100 through a through via provided in the structure. Meanwhile, unlike the seventeenth embodiment, the second conductor pattern 100 is not provided with an opening.

A ground pattern 50 is provided in a layer provided with the first conductor pattern 200. The ground pattern 50 is provided so as to surround a plurality of unit cells 10 arranged in a lattice shape. The external conductor of the coaxial cable is connected to either the first conductor pattern 200 or the third conductor pattern 400.

In the embodiment, the same effect as that of the fifteenth embodiment can also be obtained.

Figure 37:
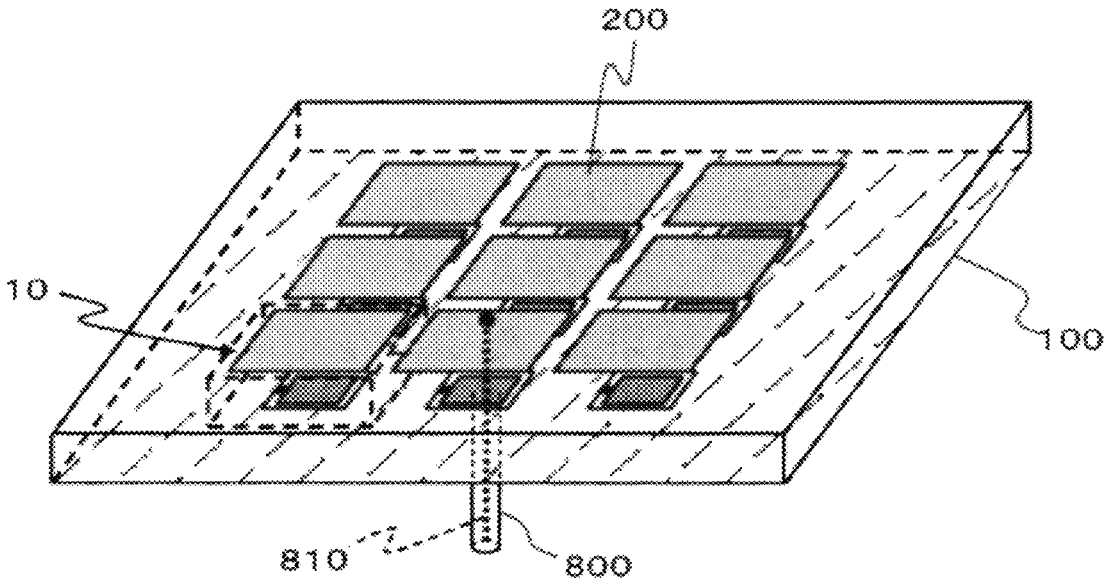
FIG. 37 is a perspective view illustrating a configuration of an antenna according to a nineteenth embodiment.
Figure 38:
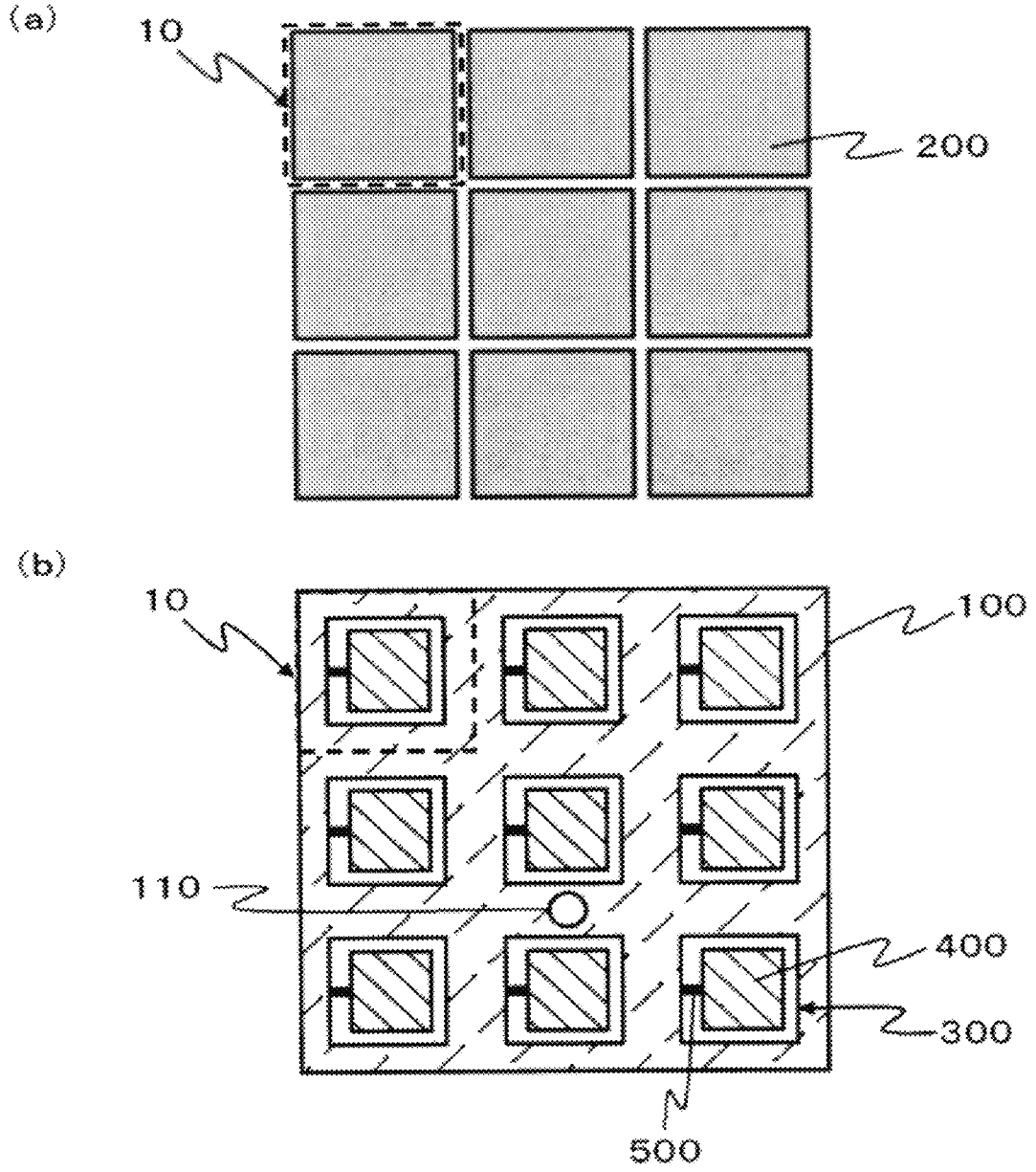
FIG. 38(*a*) is a plan view illustrating a configuration of a first layer of the antenna shown in FIG. 37, and FIG. 38(*b*) is a plan view illustrating a configuration of a second layer.

FIG. 37 is a perspective view illustrating a configuration of an antenna according to a nineteenth embodiment. FIG. 38(*a*) is a plan view illustrating a configuration of a layer (first layer) in which the first conductor pattern 200 of the antenna shown in FIG. 37 is provided. FIG. 38(*b*) is a plan view illustrating a configuration of a layer (second layer) in which the second conductor pattern 100 of the antenna shown in FIG. 37 is provided. This antenna has the same configuration as that of the antenna shown in FIG. 34, except that the resonator is formed of the structure according to the eleventh embodiment.

In the embodiment, the coaxial cable 800 is connected to the surface of the structure provided with the second conductor pattern 100. The second conductor pattern 100 is provided with the opening 110. The opening 110 is located between the openings 300. The coaxial cable 800 is connected to the opening 110. The internal conductor 810 of the coaxial cable 800 is connected to any of the first conductor patterns 200 through a through via provided in the structure. This through via is provided in a position overlapping the opening 110 in a plan view.

In the embodiment, the same effect as that of the fifteenth embodiment can also be obtained.

Figure 39:
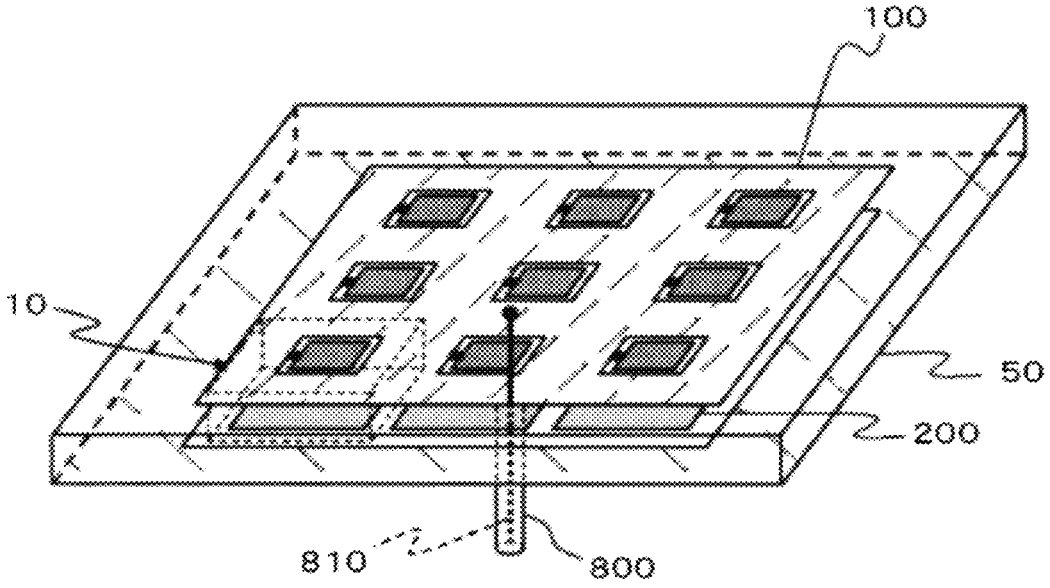
FIG. 39 is a perspective view illustrating a configuration of an antenna according to a twentieth embodiment.
Figure 40:
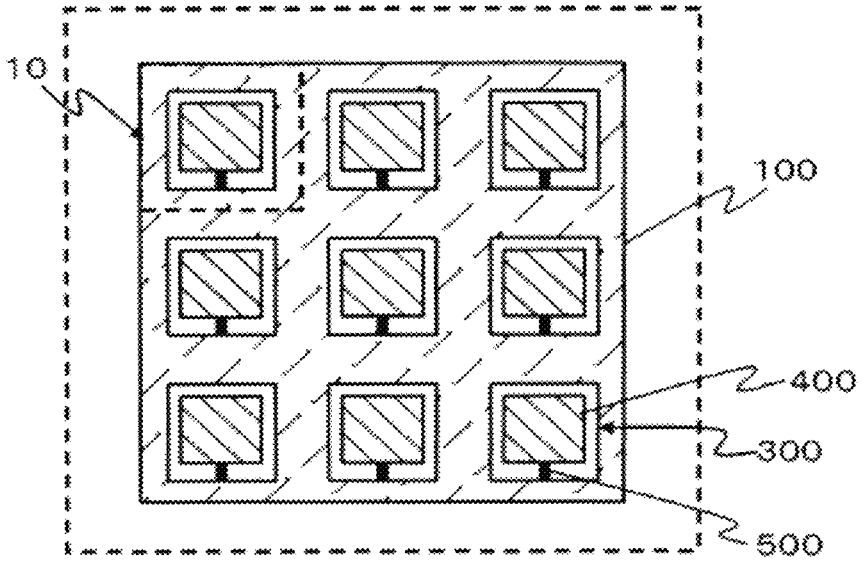
FIG. 40(*a*) is a plan view illustrating a configuration of a second layer of the antenna shown in FIG. 39, and FIG. 40(*b*) is a plan view illustrating a configuration of a first layer.
Figure 40:
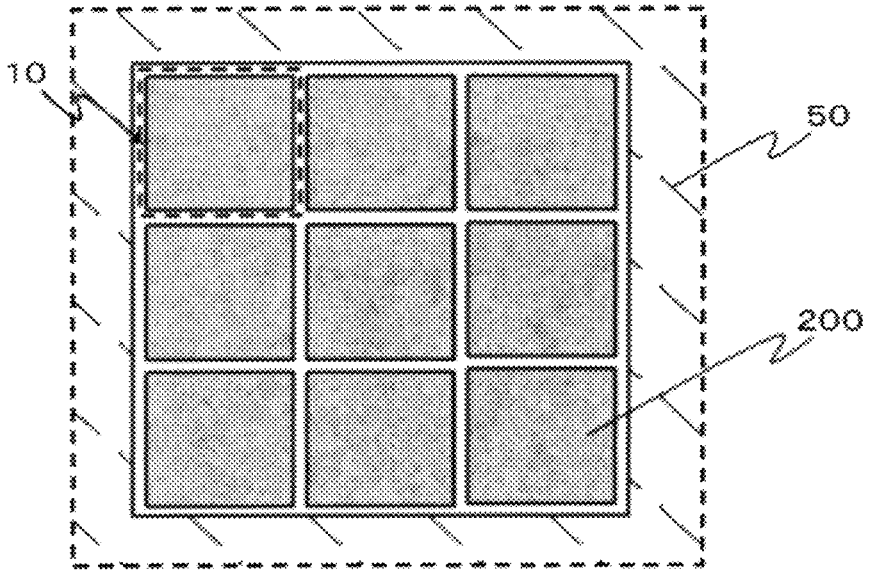

FIG. 39 is a perspective view illustrating a configuration of an antenna according to a twentieth embodiment. FIG. 40(*a*) is a plan view illustrating a configuration of a layer (second layer) in which the second conductor pattern 100 of the antenna shown in FIG. 39 is provided. FIG. 40(*b*) is a plan view illustrating a configuration of a layer (first layer) in which the first conductor pattern 200 of the antenna shown in FIG. 39 is provided. This antenna has the same configuration as the antenna shown in FIGS. 37 and 38, except that the coaxial cable 800 is connected to a layer in which the first conductor pattern 200 is provided.

In the embodiment, the coaxial cable 800 is connected so that a region between the first conductor patterns 200 overlaps the internal conductor 810. The internal conductor 810 of the coaxial cable 800 is connected to the second conductor pattern 100 through a through via provided in the structure.

In the embodiment, the same effect as that of the fifteenth embodiment can also be obtained.

Figure 41:
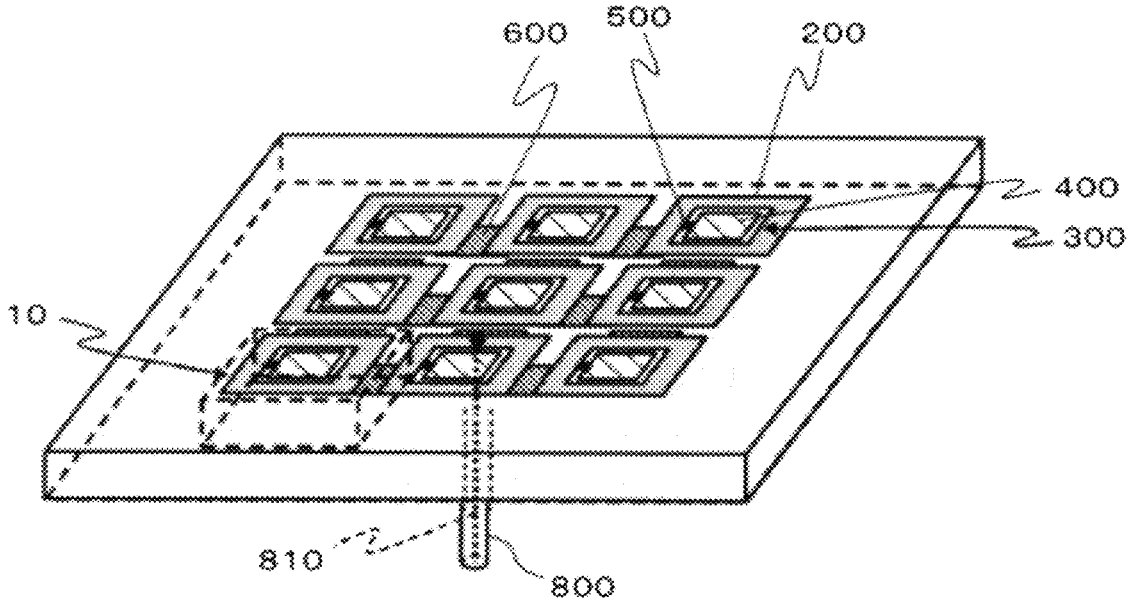
FIG. 41 is a perspective view illustrating a configuration of an antenna according to a twenty-first embodiment.

FIG. 41 is a perspective view illustrating a configuration of an antenna according to a twenty-first embodiment. This antenna has the same configuration as the antenna shown in FIG. 34, except that the resonator is formed of the structure shown in FIG. 17. Meanwhile, the through via connecting the internal conductor 810 of the coaxial cable 800 to the first conductor pattern 200 is disposed so as not to overlap the fourth conductor pattern 600.

In the embodiment, the same effect as that of the fifteenth embodiment can also be obtained.

Figure 42:
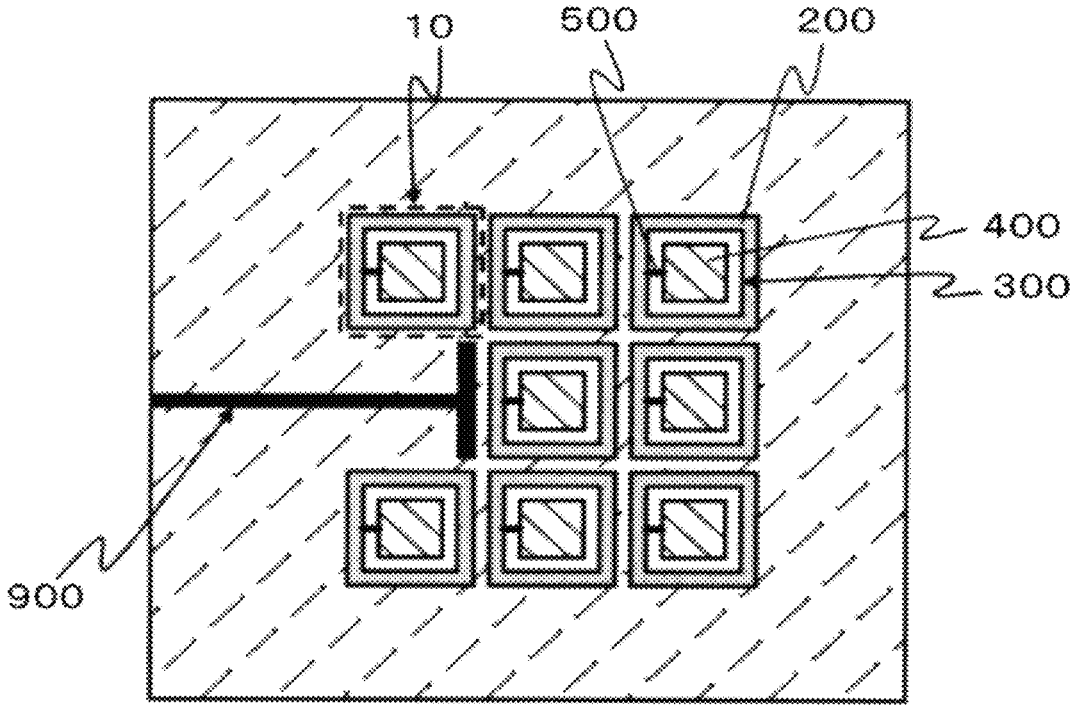
FIG. 42 is a plan view illustrating a configuration of an antenna according to a twenty-second embodiment.

FIG. 42 is a plan view illustrating a configuration of an antenna according to a twenty-second embodiment. This antenna has the same configuration as the antenna according to the fifteenth embodiment, except for the following points. First, the lattice indicating the array of the unit cells 10 has a lattice defect. This lattice defect is located at the center of the side in the lattice to which the feed line 900 is connected. The feed line 900 extends through the lattice defect, and is capacitively coupled to the first conductor pattern 200 of the unit cell 10 located inside the outermost circumference.

In the embodiment, the same effect as that of the fifteenth embodiment can also be obtained. In addition, it is possible to adjust the input impedance of the antenna by adjusting the position and the number of lattice defects.

Figure 43:
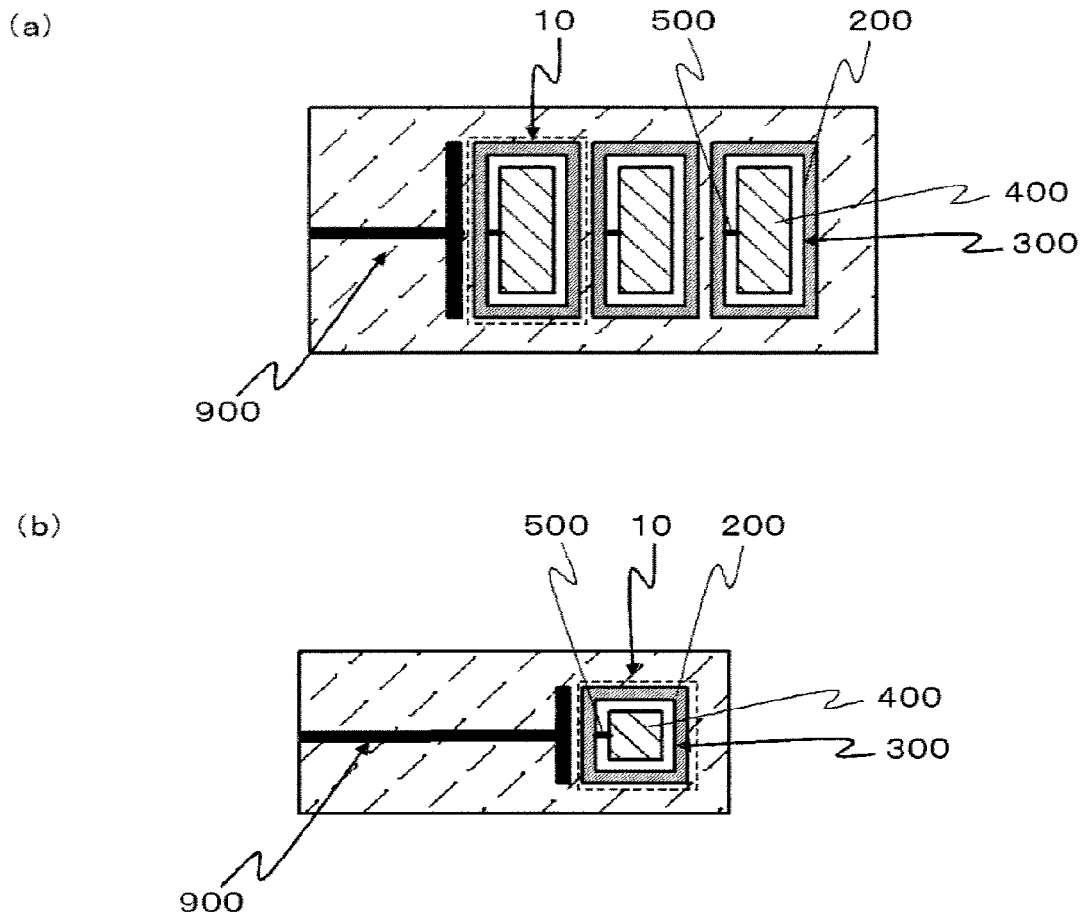
FIG. 43 is a plan view illustrating a configuration of an antenna according to a twenty-third embodiment.
Figure 44:
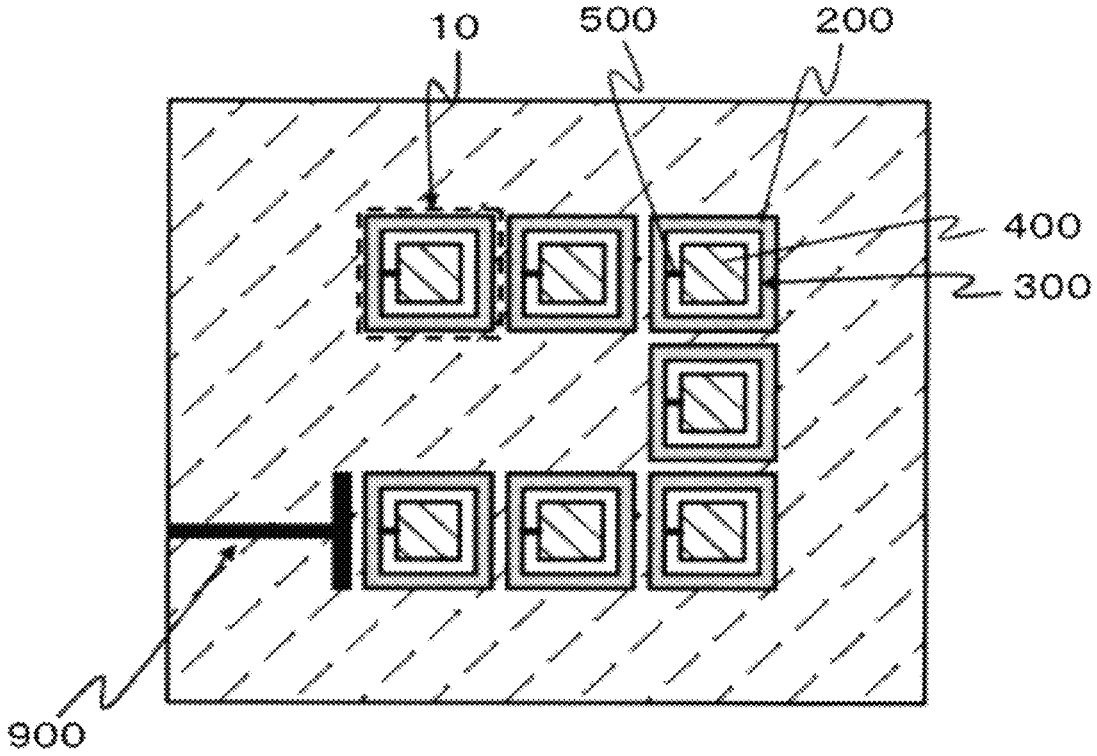
FIG. 44 is a plan view illustrating the configuration of the antenna according to the twenty-third embodiment.

FIGS. 43 and 44 are plan views illustrating a configuration of an antenna according to a twenty-third embodiment. This antenna has the same configuration as the antenna according to the fifteenth embodiment, except that the structure is formed of a one-dimensional array of the unit cells 10.

In the example shown in FIG. 43(*a*), the first conductor pattern 200, the opening 300, and the third conductor pattern 400 are rectangular, and are similar to each other. The first conductor pattern 200, the opening 300, and the third conductor pattern 400 are disposed in the same direction. The unit cells 10 are disposed along the straight line. The feed line 900 faces the long side of the first conductor pattern 200. In the example shown in FIG. 43(*b*), the structure is formed of one unit cell 10.

In the example shown in FIG. 44, the unit cells 10 are disposed along the line having a bending portion.

In the embodiment, the same effect as that of the fifteenth embodiment can also be obtained.

Figure 45:
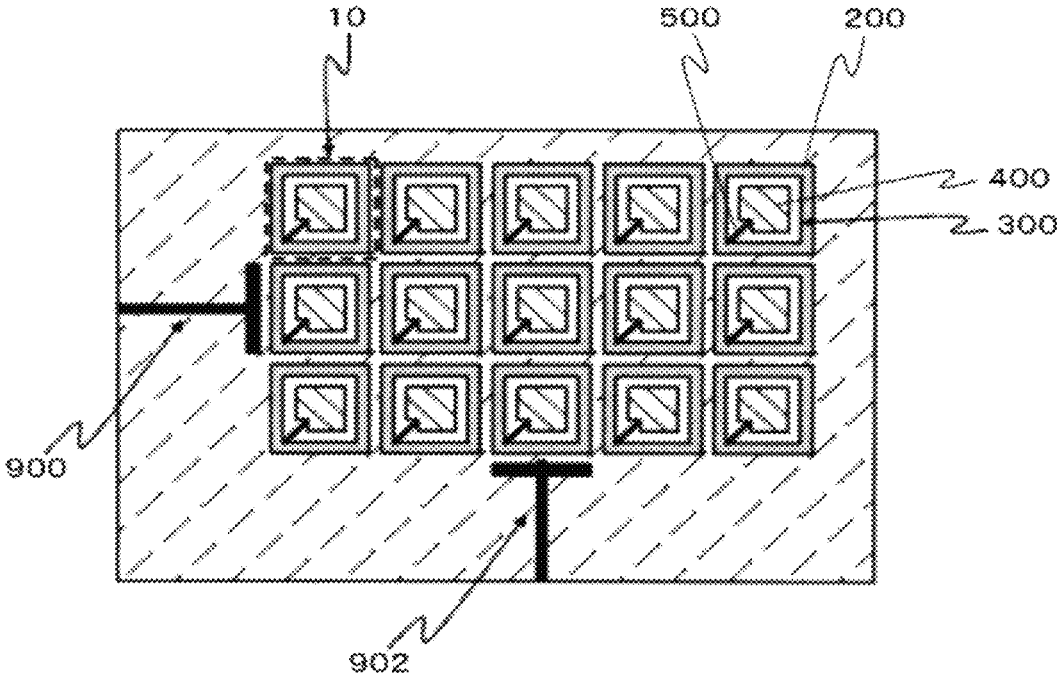
FIG. 45 is a plan view illustrating a configuration of an antenna according to a twenty-fourth embodiment.

FIG. 45 is a plan view illustrating a configuration of an antenna according to a twenty-fourth embodiment. This antenna has the same configuration as the antenna according to the fifteenth embodiment, except for the following points. First, a plurality of first conductor patterns 200, that is, the unit cells 10 are arranged in a periodic two-dimensional array to form a rectangular lattice. Specifically, the unit cells 10 are square, and the number of unit cells 10 constituting the long side is larger than the number of unit cells 10 constituting the short side. The feed line 900 is capacitively coupled to the first conductor pattern 200 located at the short side of the lattice. A second feed line 902 is capacitively coupled to the first conductor pattern 200 located at the long side of the lattice.

More specifically, the feed line 900 is capacitively coupled to the first conductor pattern 200 constituting the unit cell 10 located at the short side of the lattice constituted by the unit cell 10. The feed line 902 is capacitively coupled to the unit cell 10 located at the center of the long side. Both of the feed lines 900 and 902 include an auxiliary pattern in the portion opposite the first conductor pattern 200. This pattern has the same length as the side of the first conductor pattern 200 opposite the feed lines 900 and 902.

In the embodiment, the same effect as that of the fifteenth embodiment can also be obtained. In addition, the unit cells 10 are arranged in a periodic two-dimensional array to form a rectangular lattice. Also, the feed lines 900 and 902 are capacitively coupled to the short side and the long side of the lattice, respectively. In the resonator of the antenna, the resonance frequency in the direction of the rectangular short side is different from the resonance frequency in the direction of the long side. For this reason, the dual band of the antenna can be achieved.

Figure 46:
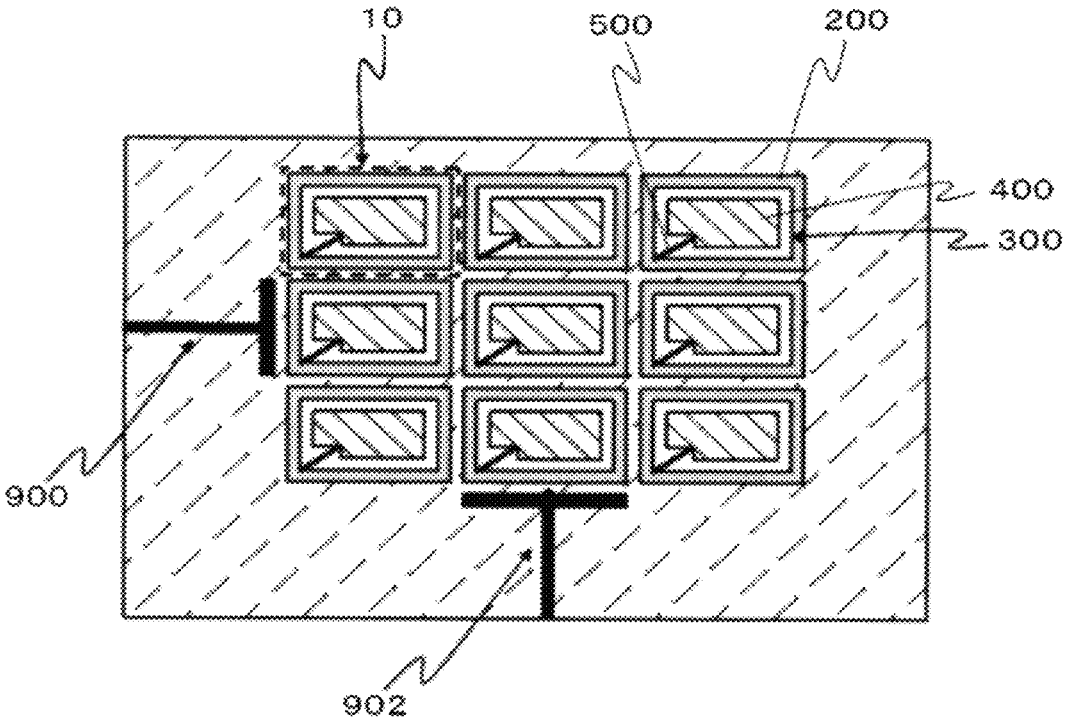
FIG. 46 is a plan view illustrating a configuration of an antenna according to a twenty-fifth embodiment.

FIG. 46 is a plan view illustrating a configuration of an antenna according to a twenty-fifth embodiment. This antenna has the same configuration as the antenna according to the twenty-fourth embodiment, except that the unit cell 10 is set to be rectangular and the numbers of unit cells 10 constituting each of the sides are set to be the same as each other, and thus a rectangular lattice is formed.

Also in the embodiment, the dispersion curve of electromagnetic waves propagating the direction of the long side of the lattice is different from the dispersion curve of electromagnetic waves propagating in the direction of the short side of the lattice. For this reason, the dual band of the antenna can be achieved.

Figure 47:
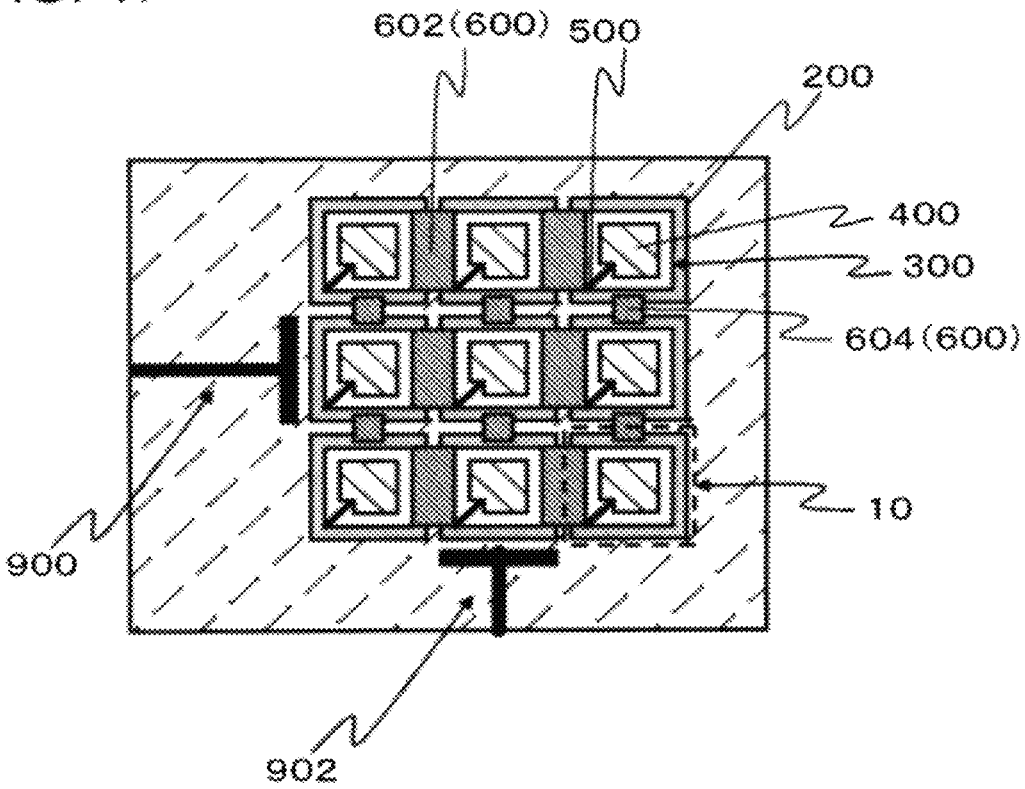
FIG. 47 is a plan view illustrating a configuration of an antenna according to a twenty-sixth embodiment.

FIG. 47 is a plan view illustrating a configuration of an antenna according to a twenty-sixth embodiment. This antenna has the same configuration as the antenna shown in FIG. 41, except for the following points. First, in the fourth conductor patterns 600, the area of a fourth conductor pattern 602 that allows the unit cells 10 to be coupled to each other in the row direction is different from the area of a fourth conductor pattern 604 that allows the unit cells 10 to be coupled to each other in the column direction. The antenna is supplied with power through the feed lines 900 and 902 instead of the coaxial cable 800. Meanwhile, the fourth conductor patterns 602 and 604 are located above the first conductor pattern 200 in the drawing, but the fourth conductor patterns 602 and 604 may be located between a layer in which the first conductor pattern 200 is provided and a layer in which the second conductor pattern 100 is provided.

In the embodiment, when electromagnetic waves propagate in the row direction of the lattice, the fourth conductor pattern 602 that allows the unit cells 10 to be coupled to each other in the row direction appears in the equivalent circuit of the resonator. When electromagnetic waves propagate in the column direction of the lattice, the fourth conductor pattern 604 that allows the unit cells 10 to be coupled to each other in the column direction appears in the equivalent circuit of the resonator. As mentioned above, the areas of the fourth conductor patterns 602 and 604 are different from each other. For this reason, the equivalent circuit where electromagnetic waves propagate in the row direction of the lattice can be made different from the equivalent circuit where electromagnetic waves propagate in the column direction of the lattice. Thus, the resonance frequency at which electromagnetic waves propagate in the row direction of the lattice can be made different from the resonance frequency at which electromagnetic waves propagate in the column direction of the lattice. As a result, the dual band of the antenna can be achieved.

Figure 48:
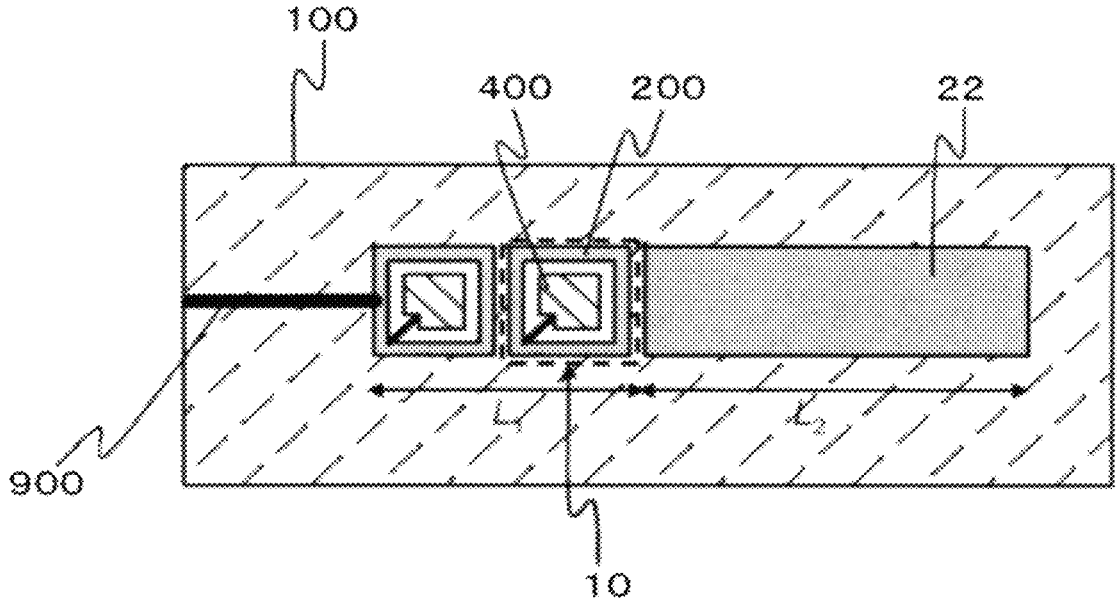
FIG. 48 is a top view illustrating a configuration of an antenna according to a twenty-seventh embodiment.

FIG. 48 is a top view illustrating a configuration of an antenna according to a twenty-seventh embodiment. This antenna has the same configuration as the antenna shown in FIG. 33, except for the following points. First, the unit cell 10 has the configuration shown in FIG. 9. The unit cells 10 are arranged in a one-dimensional array along a first straight line. After the arrangement of the unit cells 10, a fifth conductor pattern 22 for a fifth conductor is provided on the same layer as the first conductor pattern 200. The fifth conductor pattern 22 extends in the direction along the first straight line. Meanwhile, the width of the fifth conductor pattern 22 is equal to the width of the first conductor pattern 200. The distance between the fifth conductor pattern 22 and the first conductor pattern 200 located at the end of the arrangement is equal to the arrangement interval between the first conductor patterns 200.

Figure 49:
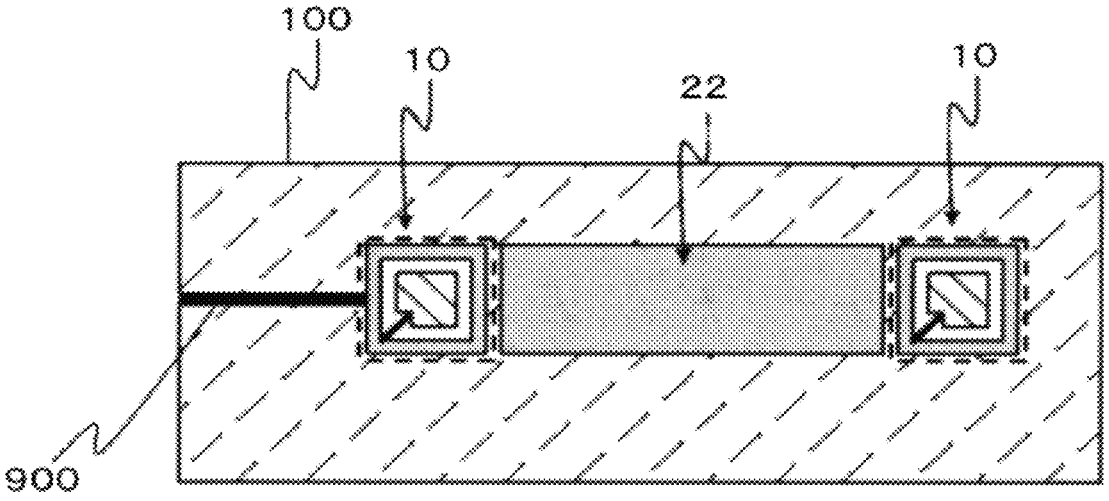
FIG. 49 is a top view illustrating a first modified example of the antenna shown in FIG. 48.

FIG. 49 is a top view illustrating a first modified example of the antenna shown in FIG. 48. This antenna has the same configuration as the antenna shown in FIG. 48, except that the fifth conductor pattern 22 is provided in a position to separate the array of the unit cells 10.

Figure 50:
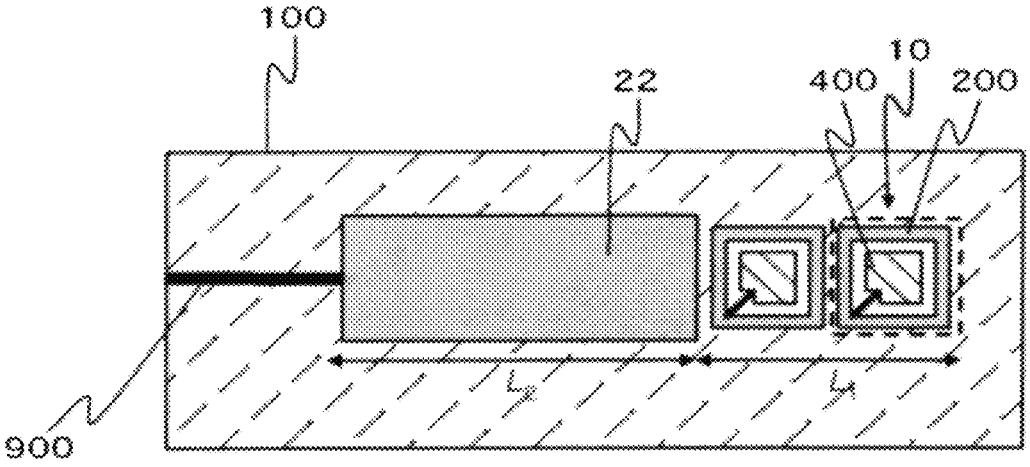
FIG. 50 is a top view illustrating a second modified example of the antenna shown in FIG. 48.

FIG. 50 is a top view illustrating a second modified example of the antenna shown in FIG. 48. This antenna has the same configuration as the antenna shown in FIG. 48, except that the feed line 900 is connected to the fifth conductor pattern 22, and that the one-dimensional array of the unit cells 10 is provided behind the feed line 900.

In these antennas, the second conductor pattern 100 also extends below the fifth conductor pattern 22. A transmission line is formed by the fifth conductor pattern 22 and the portion of the second conductor pattern 100 located below the fifth conductor pattern 22. This transmission line is a microstrip line, and is a so-called right-handed-system transmission line.

If, when a signal is input to the antenna, the phase difference $\Delta\theta_1=L_1/\lambda_1$ in the array of the unit cells 10 is equal to the phase difference $\Delta\theta_2=L_2/\lambda_2$ in the fifth conductor pattern 22 where $\lambda 1$ is the wavelength of the signal in the array of the unit cells 10 and $\lambda 2$ is the wavelength of the signal in the fifth conductor pattern 22, the array of the unit cells 10 and the fifth conductor pattern 22 are integrally formed and thus a resonator is formed. The array of the unit cells 10 is a left-handed-system transmission line. The fifth conductor pattern 22 and the second conductor pattern 100 located under the fifth conductor pattern 22 are right-handed-system transmission lines.

According to the embodiment, the number of unit cells 10 is reduced and thus $L_2$ is shortened. As a result, the length of the resonator is allowed to be decreased.

Figure 51:
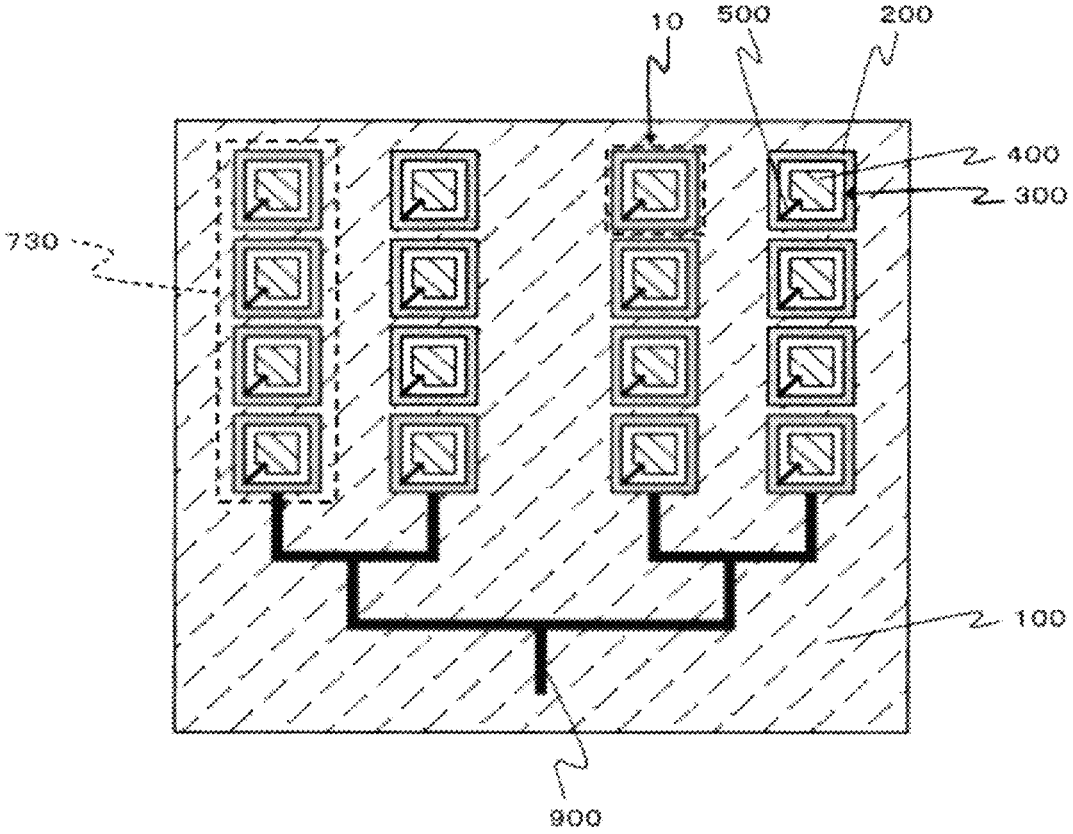
FIG. 51 is a plan view illustrating a configuration of an antenna according to a twenty-eighth embodiment.

FIG. 51 is a plan view illustrating a configuration of an antenna according to a twenty-eighth embodiment. This antenna is an array antenna, and includes a plurality of array elements 730 arranged in parallel. Each of the array elements 730 has the same structure, and has a configuration in which a plurality of unit cells 10 are arranged. In the example shown in the drawing, a plurality of unit cells 10 are arranged in a one-dimensional array to form a linear shape. The feed line 900 is connected to each of the array elements 730. The configuration of the feed line 900 is the same configuration as mentioned above, and forms a microstrip line together with the second conductor pattern 100.

In the antenna according to the embodiment, directionality is beam-shaped. It is possible to increase a gain of the antenna in the direction to which the beam points.

Figure 52:
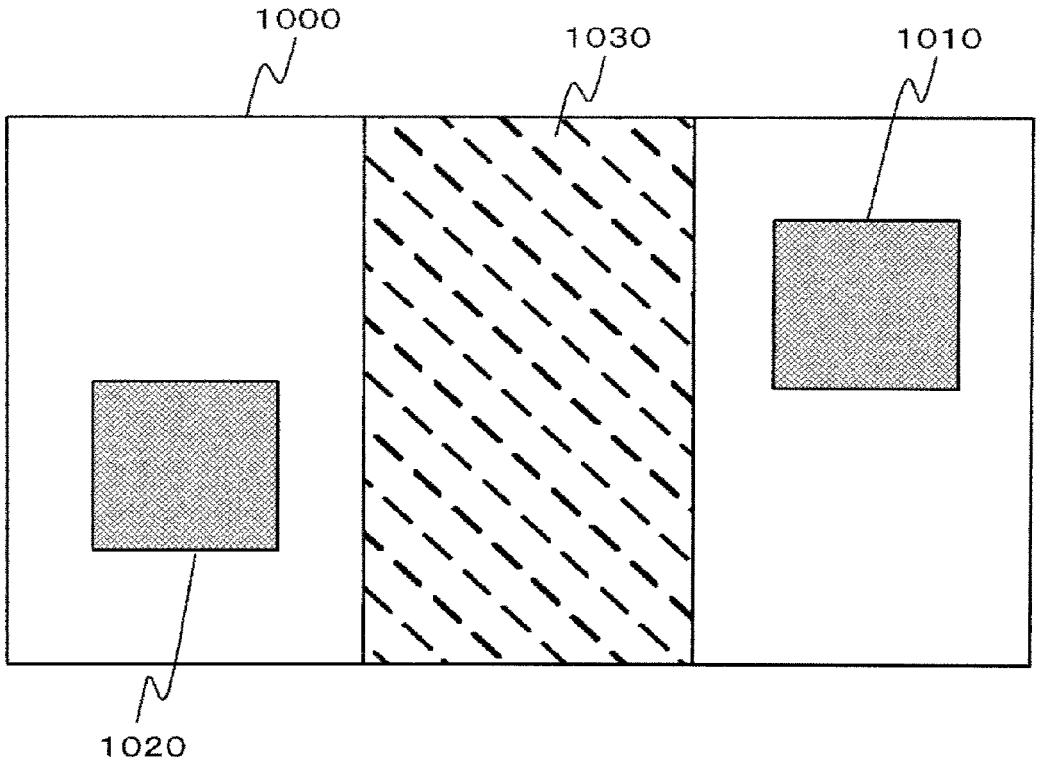
FIG. 52 is a plan view illustrating a configuration of electronic parts according to a twenty-ninth embodiment.

FIG. 52 is a plan view illustrating a configuration of electronic parts according to a twenty-ninth embodiment. The electronic parts are a first semiconductor package 1010 and a second semiconductor package 1020 mounted on a circuit substrate 1000. The circuit substrate 1000 is, for example, a printed circuit board. The first semiconductor package 1010 and the second semiconductor package 1020 are connected to a power plane and a ground plane of the circuit substrate 1000, respectively. The power plane and the ground plane of the circuit substrate 1000 are formed in conductive layers different from each other.

The circuit substrate 1000 includes an EBG region 1030. The EBG region 1030 is provided with any of the structures according to the first to twelfth embodiments. The EBG region 1030 divides a first region on which the first semiconductor package 1010 is mounted and a second region on which the second semiconductor package is mounted. The second conductor pattern 100 according to the first to twelfth embodiments is formed in the power plane or the ground plane of the circuit substrate 1000. The first conductor pattern 200 is formed in a layer different from that of the second conductor pattern 100.

In the embodiment, the first semiconductor package 1010 is a package for a noise source, and the second semiconductor package 1020 is a package susceptible to noise generated in the first semiconductor package 1010. The structure provided in the EBG region 1030 is formed so that the frequency of the noise is located at a band gap zone.

Figure 53:
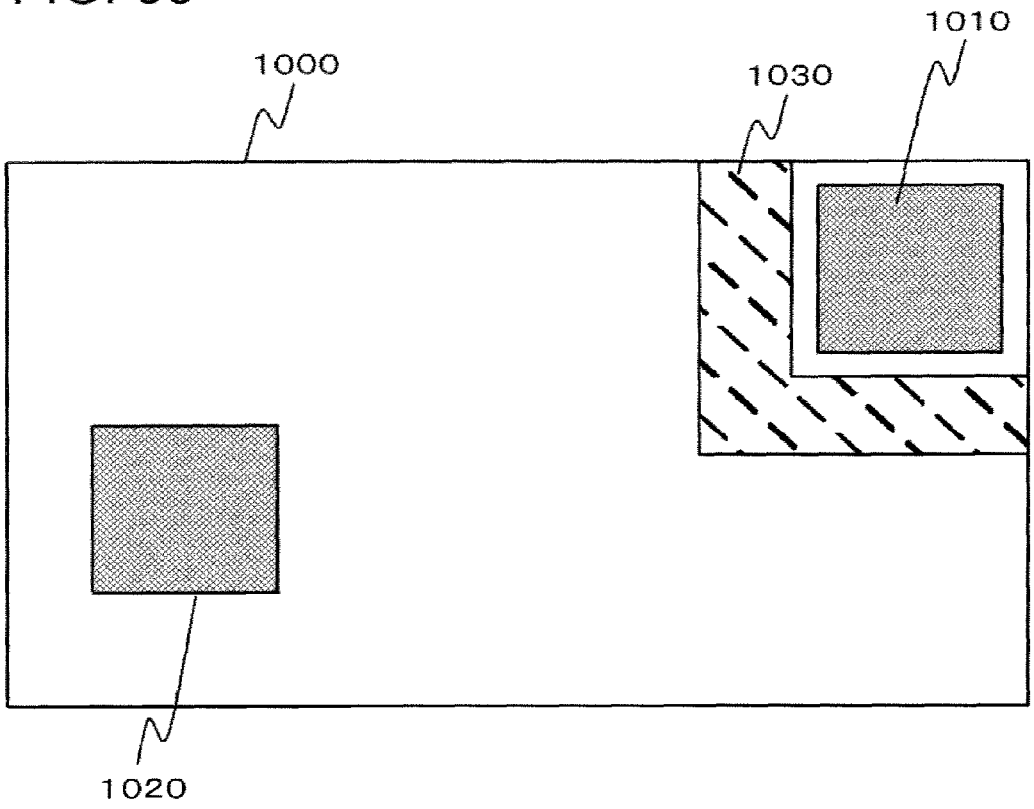
FIG. 53 is a plan view illustrating a configuration of a modified example of the electronic parts according to the twenty-ninth embodiment.
Figure 54:
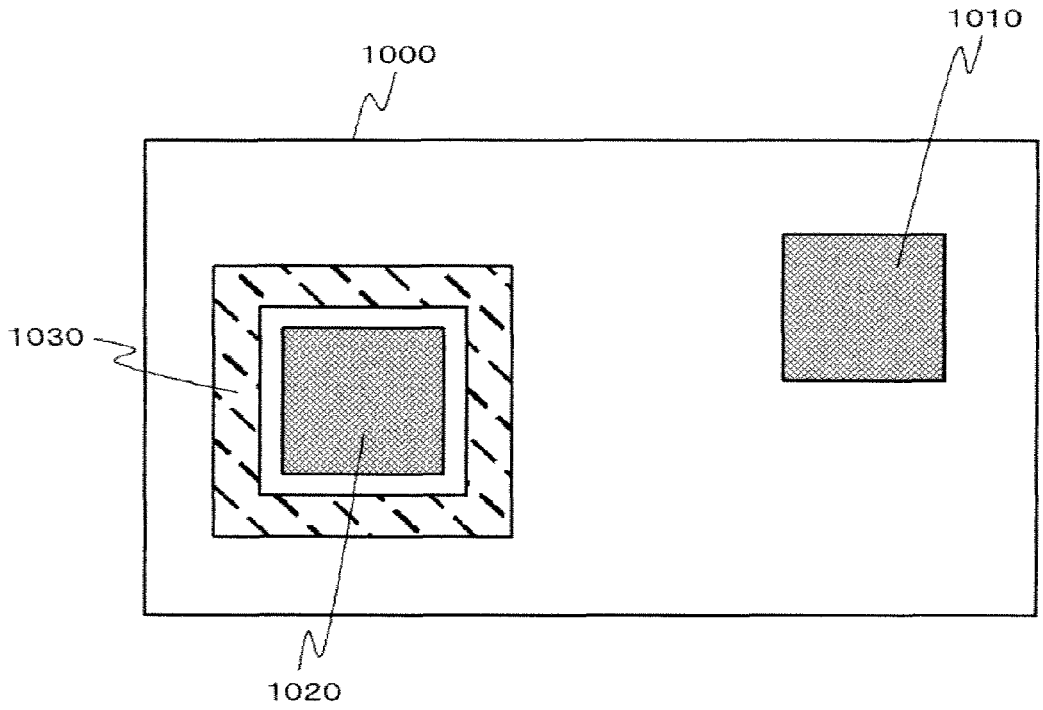
FIG. 54 is a plan view illustrating the configuration of the modified example of the electronic parts according to the twenty-ninth embodiment.

In FIG. 52, the EBG region 1030 is arranged in a band shape between the semiconductor packages 1010 and 1020. Nevertheless, the EBG region 1030 may be formed to surround the first semiconductor package 1010 as shown in FIG. 53. Alternatively, the EBG region 1030 may be formed to surround the second semiconductor package 1020 as shown in FIG. 54.

According to the embodiment, any of the structures of the first to twelfth embodiments is disposed as a noise filter in a portion of a power or ground layer. Thus, it is possible to suppress a flow of an unnecessary high-frequency current from the semiconductor package 1010 serving as a noise source to the power plane or the ground plane of the circuit substrate 1000. Moreover, it is possible to suppress malfunction of the semiconductor package 1020 susceptible to noise, and to prevent unnecessary electromagnetic waves from emitting from the circuit substrate 1000.

As described above, although the embodiments of the invention have been set forthwith reference to the drawings, they are merely illustrative of the invention, and various configurations other than stated above can be adopted.

The application claims priority from Japanese Patent Application No. 2009-277551 filed on Dec. 7, 2009, the content of which is incorporated herein by reference in its entirety.

The invention claimed is:

1. A structure comprising:

a plurality of first insular conductors located at a first layer and arranged in a repetitive pattern;

a second conductor located at a second layer different from the first layer, at least a portion of the second conductor being provided in a region opposite the plurality of first conductors;

an opening provided in the plurality of first conductors;

a third conductor located at the first layer and arranged in the opening, the third conductor being separated from the first conductors; and a connection conductor connecting the third conductor to the first conductors.

2. The structure according to claim 1, wherein the connection conductor extends so as to surround the third conductor within the opening.

3. The structure according to claim 1, wherein the connection conductor extends in a meandering shape within the opening.

4. The structure according to claim 1, wherein the third conductor has a concave portion in a planar shape, and is connected to the connection conductor at a bottom of the concave portion.

5. The structure according to claim 1, wherein a planar shape of the first conductors is regular hexagonal.

6. The structure according to claim 1, wherein the plurality of first conductors are arranged in a first direction, and the connection conductor is provided at regular intervals and perpendicular to the first direction.

7. The structure according to claim 1, wherein the plurality of first conductors, the opening, and the third conductor are square, and the connection conductor connects a first corner corresponding to one corner of the opening to a second corner of the third conductor opposite the first corner.

8. The structure according to claim 7, wherein the third conductor has a notch in the second corner.

9. The structure according to claim 1, wherein the connection conductor comprises a chip inductor.

10. The structure according to claim 1, wherein one of the first conductors has plural sets of the opening, the third conductor, and the connection conductor.

11. The structure according to claim 10, wherein the plurality of first conductors are arranged in a first direction, and one of the first conductors has two sets of the opening, the third conductor, and the connection conductor in a line-symmetric arrangement with respect to the first direction.

12. The structure according to claim 10, wherein one of the first conductors has three sets or more of the opening, the third conductor, and the connection conductor in an arrangement along one circle, and each of the three or more connection conductors extends in a direction passing through a center of the circle.

13. The structure according to claim 1, further comprising a plurality of fourth conductors located between the first layer and the second layer, or at a third layer located opposite the second layer through the first layer, the fourth conductors being formed to straddle each of the plurality of first conductors in a plan view.

14. The structure according to claim 13, wherein the fourth conductors have a line-symmetric planar shape with respect to a mutual relation between the plurality of first conductors.

15. An antenna comprising the structure according to claim 13, wherein the structure serves as a resonator of a resonator antenna, the first conductors are arranged in a two-dimensional array to form a lattice, and each area of the fourth conductors allowing the first conductors to be coupled to each other in a column direction of the lattice is different in size from each area of the fourth conductors allowing the second conductor to be coupled to each other in a row direction of the lattice.

16. The structure according to claim 1, wherein the plurality of first conductors are arranged in a periodic two-dimensional array to form a lattice, and are not arranged in at least one lattice point of the lattice.

17. An antenna comprising the structure according to claim 1.

18. The antenna according to claim 17, wherein the structure serves as a reflective plate.

19. The antenna according to claim 18, further comprising:

an opening provided in the second conductor and located in a region in which none of the first conductors is provided in a plan view; and an antenna element connected through the opening to a feed line located at a back side of the reflective plate, the antenna element extending upward above the first layer through the region in which none of the first conductors is provided.

20. The antenna according to claim 19, further comprising a coaxial cable, an internal conductor of the coaxial cable serving as the feed line and connected to the antenna element, an external conductor of the coaxial cable being connected to the second conductor.

21. The antenna according to claim 17, wherein the structure serves as a resonator of a resonator antenna.

22. The antenna according to claim 21, further comprising a feed line provided in the first layer.

23. The antenna according to claim 22, wherein the first conductors have a square or rectangular shape, and the feed line is capacitively coupled to some conductor of the first conductors.

24. The antenna according to claim 23, wherein the plurality of first conductors are arranged in a periodic two-dimensional array to form a rectangular lattice, and the antenna further comprises:

a first feed line capacitively coupled to the first conductor located at a short side of the lattice; and a second feed line capacitively coupled to the first conductor located at a long side of the lattice.

25. The antenna according to claim 23, wherein the plurality of first conductors are rectangular, and are arranged in a periodic two-dimensional array to form a lattice, and the antenna further comprises:

a first feed line capacitively coupled to the first conductor located at a first side of the lattice; and a second feed line capacitively coupled to the first conductor located at a second side of the lattice intersecting the first side.

26. The antenna according to claim 21, wherein a feed line is directly connected to the second conductor or some conductor of the first conductors.

27. The antenna according to claim 21, further comprising:

a fifth conductor provided in the first layer, the fifth conductor being located next to an array of the first conductors, or in a position to separate the array of the first conductors, an extending length of the fifth conductor being greater than a length of the array of the plurality of first conductors, wherein the second conductor extends also in a region opposite the fifth conductor.

28. A structure comprising:

a plurality of first conductors located at a first layer and arranged in a repetitive pattern;

a second conductor located at a second layer different from the first layer, at least a portion of the second conductor being provided in a region opposite the plurality of first conductors;

a plurality of openings provided in the second conductor, the openings being opposite the plurality of first conductors;

a third conductor located at the second layer and arranged in the plurality of openings; and a connection conductor connecting the third conductor to the first conductors.

* * * * *